US011065882B2

(12) United States Patent
Shindo

(10) Patent No.: US 11,065,882 B2
(45) Date of Patent: Jul. 20, 2021

(54) IMAGE-RECORDING DEVICE HAVING FIRST SENSOR FOR DETECTING LIQUID IN CARTRIDGE AND SECOND SENSOR FOR DETECTING LIQUID IN TANK

(71) Applicant: Brother Kogyo Kabushiki Kaisha, Nagoya (JP)

(72) Inventor: Tatsuya Shindo, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/832,196

(22) Filed: Mar. 27, 2020

(65) Prior Publication Data

US 2020/0307241 A1 Oct. 1, 2020

(30) Foreign Application Priority Data

Mar. 29, 2019 (JP) ..... JP2019-066018

(51) Int. Cl.
*B41J 2/195* (2006.01)
*B41J 2/175* (2006.01)

(52) U.S. Cl.
CPC ..... *B41J 2/17566* (2013.01); *B41J 2/17553* (2013.01)

(58) Field of Classification Search
None
See application file for complete search history.

(56) References Cited

U.S. PATENT DOCUMENTS

2005/0057586 A1* 3/2005 Brenner ..... B41J 2/17566 347/7
2008/0303848 A1* 12/2008 Umeda ..... B41J 2/17596 347/6
2011/0050793 A1* 3/2011 Kumagai ..... B41J 2/17596 347/22
2011/0285768 A1* 11/2011 Preckel ..... B41J 3/40733 347/6
2016/0023469 A1* 1/2016 Adachi ..... B41J 2/17566 347/85
2018/0281397 A1* 10/2018 Takagi ..... B41J 2/1752
2019/0100013 A1* 4/2019 Iida ..... B41J 2/16517

FOREIGN PATENT DOCUMENTS

JP 2006-199041 A 8/2006
JP 2017-213754 A 12/2017

* cited by examiner

*Primary Examiner* — Erica S Lin
*Assistant Examiner* — Tracey M McMillion
(74) *Attorney, Agent, or Firm* — Banner & Witcoff, Ltd.

(57) ABSTRACT

In an image-recording device, a cartridge has a first chamber, a first outlet, and a first sensor. A mount body includes a tank in connection with the cartridge, and a second sensor. The tank has an inlet, and a second chamber. The liquid in the first chamber is capable of flowing into the second chamber via the first outlet of the cartridge and the inlet of the tank. The first sensor outputs a first signal when a level of the liquid in the second chamber is higher than a first position, and outputs a second signal when the level is lower than the first position. The second sensor outputs a third signal when the level is higher than a second position, and outputs the fourth signal when the level is lower than the second position.

12 Claims, 20 Drawing Sheets

FIG. 8

| FIRST LIQUID LEVEL SENSOR 61 | SECOND LIQUID LEVEL SENSOR 62 | MOUNTING RESULTS | C_Empty | C_NEmpty | S_Empty |
|---|---|---|---|---|---|
| L → L | L → L | NORMAL CARTRIDGE HAS BEEN MOUNTED | OFF | OFF | OFF |
| | H → H | AT LEAST ONE SENSOR HAS MALFUNCTIONED | | | |
| | L → H | AT LEAST ONE SENSOR HAS MALFUNCTIONED | | | |
| | H → L | NORMAL CARTRIDGE HAS BEEN MOUNTED | OFF | OFF | OFF |
| H → H | L → L | CARTRIDGE HAVING LOW RESIDUAL QUANTITY HAS BEEN MOUNTED | OFF | ON | OFF |
| | H → H | CARTRIDGE HAVING NO INK HAS BEEN MOUNTED | ON | ON | ON |
| | L → H | AT LEAST ONE SENSOR HAS MALFUNCTIONED | | | |
| | H → L | CARTRIDGE HAVING LOW RESIDUAL QUANTITY HAS BEEN MOUNTED | OFF | ON | OFF |
| L → H | L → L | CARTRIDGE HAVING LOW RESIDUAL QUANTITY HAS BEEN MOUNTED | OFF | ON | OFF |
| | H → H | CARTRIDGE HAVING NO INK HAS BEEN MOUNTED | ON | ON | ON |
| | L → H | AT LEAST ONE SENSOR HAS MALFUNCTIONED | | | |
| | H → L | CARTRIDGE HAVING LOW RESIDUAL QUANTITY HAS BEEN MOUNTED | OFF | ON | OFF |
| H → L | L → L | INK HAS BEEN FLOWED UPSTREAM FROM TANK TO CARTRIDGE | OFF | OFF | OFF |
| | H → H | AT LEAST ONE SENSOR HAS MALFUNCTIONED | | | |
| | L → H | AT LEAST ONE SENSOR HAS MALFUNCTIONED | | | |
| | H → L | AT LEAST ONE SENSOR HAS MALFUNCTIONED | | | |

FIG. 16

| FIRST LIQUID LEVEL SENSOR 61 | SECOND LIQUID LEVEL SENSOR 62 | MOUNTING RESULTS | C_Empty | S_Empty |
|---|---|---|---|---|
| L → L | L → L | NORMAL CARTRIDGE HAS BEEN MOUNTED | OFF | OFF |
| | H → H | AT LEAST ONE SENSOR HAS MALFUNCTIONED | | |
| | L → H | AT LEAST ONE SENSOR HAS MALFUNCTIONED | | |
| | H → L | NORMAL CARTRIDGE HAS BEEN MOUNTED | OFF | OFF |
| H → H | L → L | CARTRIDGE HAVING NO INK HAS BEEN MOUNTED | ON | OFF |
| | H → H | CARTRIDGE HAVING NO INK HAS BEEN MOUNTED | ON | ON |
| | L → H | AT LEAST ONE SENSOR HAS MALFUNCTIONED | | |
| | H → L | CARTRIDGE HAVING NO INK HAS BEEN MOUNTED | ON | OFF |
| L → H | L → L | CARTRIDGE HAVING LOW RESIDUAL QUANTITY HAS BEEN MOUNTED AND CARTRIDGE HAS RUN OUT OF INK BY SUPPLYING INK TO TANK | ON | OFF |
| | H → H | CARTRIDGE HAVING LOW RESIDUAL QUANTITY HAS BEEN MOUNTED AND CARTRIDGE HAS RUN OUT OF INK BY SUPPLYING INK TO TANK | ON | ON |
| | L → H | AT LEAST ONE SENSOR HAS MALFUNCTIONED | | |
| | H → L | CARTRIDGE HAVING LOW RESIDUAL QUANTITY HAS BEEN MOUNTED AND CARTRIDGE HAS RUN OUT OF INK BY SUPPLYING INK TO TANK | ON | OFF |
| H → L | L → L | INK HAS BEEN FLOWED UPSTREAM FROM TANK TO CARTRIDGE | OFF | OFF |
| | H → H | AT LEAST ONE SENSOR HAS MALFUNCTIONED | | |
| | L → H | AT LEAST ONE SENSOR HAS MALFUNCTIONED | | |
| | H → L | AT LEAST ONE SENSOR HAS MALFUNCTIONED | | |

IMAGE-RECORDING DEVICE HAVING FIRST SENSOR FOR DETECTING LIQUID IN CARTRIDGE AND SECOND SENSOR FOR DETECTING LIQUID IN TANK

CROSS REFERENCE TO RELATED APPLICATION

This application claims priority from Japanese Patent Application No. 2019-066018 filed Mar. 29, 2019. The entire content of the priority application is incorporated herein by reference.

TECHNICAL FIELD

The present disclosure relates to an image-recording device having a tank, and a cartridge that is mounted in the image-recording device for supplying a liquid to the tank.

BACKGROUND

There is known in the art an image-recording device provided with a cartridge, and a tank. The cartridge is mounted in the image-recording device. Liquid accommodated in the cartridge is supplied to the tank. When the quantity of liquid stored in the tank of this type of image-recording device becomes low or when the tank runs out of liquid, a new cartridge is mounted on the tank. The new cartridge then supplies liquid to the tank.

In this type of image-recording device, a sensor has conventionally been provided in the tank for detecting the residual quantity of liquid therein.

SUMMARY

However, the sensor is only provided in the tank of the conventional image-recording device. Consequently, the device cannot detect the residual quantity of liquid in the cartridge with precision.

In the conventional image-recording device, the cartridge is mounted on the tank from the side, rather than from above. For image-recording devices that use the difference in hydraulic head to supply liquid from the cartridge to the tank, it is conceivable that a sensor disposed in the tank can also detect the level of liquid accommodated in the cartridge, enabling the device to detect the residual quantity of liquid stored in the cartridge. However, since the sensor in this type of image-recording device is disposed in the tank and not the cartridge, the device may not be able to detect the residual quantity of liquid in the cartridge with good precision.

Further, for the purpose that the sensor disposed in the tank is used to detect the residual quantity of liquid in the cartridge, the height of the sensor must be aligned with the mounted height of the cartridge. Consequently, the mounted position of the sensor may be set higher than the bottom of the tank. In such a case, the sensor may not detect the liquid right away because it takes time for the surface of the liquid to reach the position of the sensor after the cartridge is mounted on the tank and begins supplying liquid to the tank.

In order to shorten the time required for detection, it is conceivable that a software count has conventionally been used to determine the residual quantity of liquid in the tank. However, software counts tend to produce large error when estimating the residual quantity of liquid.

In view of the foregoing, it is an object of the present disclosure to provide an image-recording device capable of quickly detecting when liquid has been supplied from the cartridge into the tank, while improving the precision of detecting the residual quantity of liquid in the cartridge.

In order to attain the above and other objects, the disclosure provides an image-recording device. The image-recording device includes a cartridge and a mount body. The cartridge has a first chamber configured to accommodate liquid, a first outlet, and a first sensor. The cartridge is detachably mounted to a mount body. The mount body includes a tank which is configured to be in connection with the cartridge when the cartridge is mounted to the mount body, and a second sensor. The tank has an inlet, and a second chamber configured to accommodate liquid. The liquid in the first chamber is capable of flowing into the second chamber via the first outlet of the cartridge and the inlet of the tank. The first sensor of the cartridge is configured to output a first signal when a level of the liquid accommodated in the second chamber is higher than a first position whereas the first sensor is configured to output a second signal when the level of the liquid accommodated in the second chamber is lower than the first position. The second sensor of the tank is configured to output a third signal when a level of the liquid accommodated in the second chamber is higher than a second position whereas the second sensor is configured to output the fourth signal when the level of the liquid accommodated in the second chamber is lower than the second position.

BRIEF DESCRIPTION OF THE DRAWINGS

The particular features and advantages of the disclosure as well as other objects will become apparent from the following description taken in connection with the accompanying drawings, in which:

FIG. 8 is a table illustrating mounting results according to signals from a first liquid level sensor and a second liquid level sensor in the printer according to the first embodiment;

FIG. 16 is a table illustrating mounting results according to signals from a first liquid level sensor and a second liquid level sensor in the printer according to the second embodiment;

DETAILED DESCRIPTION

Next, embodiments of the present disclosure will be described while referring to the accompanying drawings. Note that the embodiments described below are merely an example of the disclosure and may be modified in many ways without departing from the spirit of the disclosure, the scope of which is defined by the attached claims. Further, the order in which each of the processes described below are executed may be modified as desired without departing from the scope of the disclosure.

First Embodiment

Figure 1:
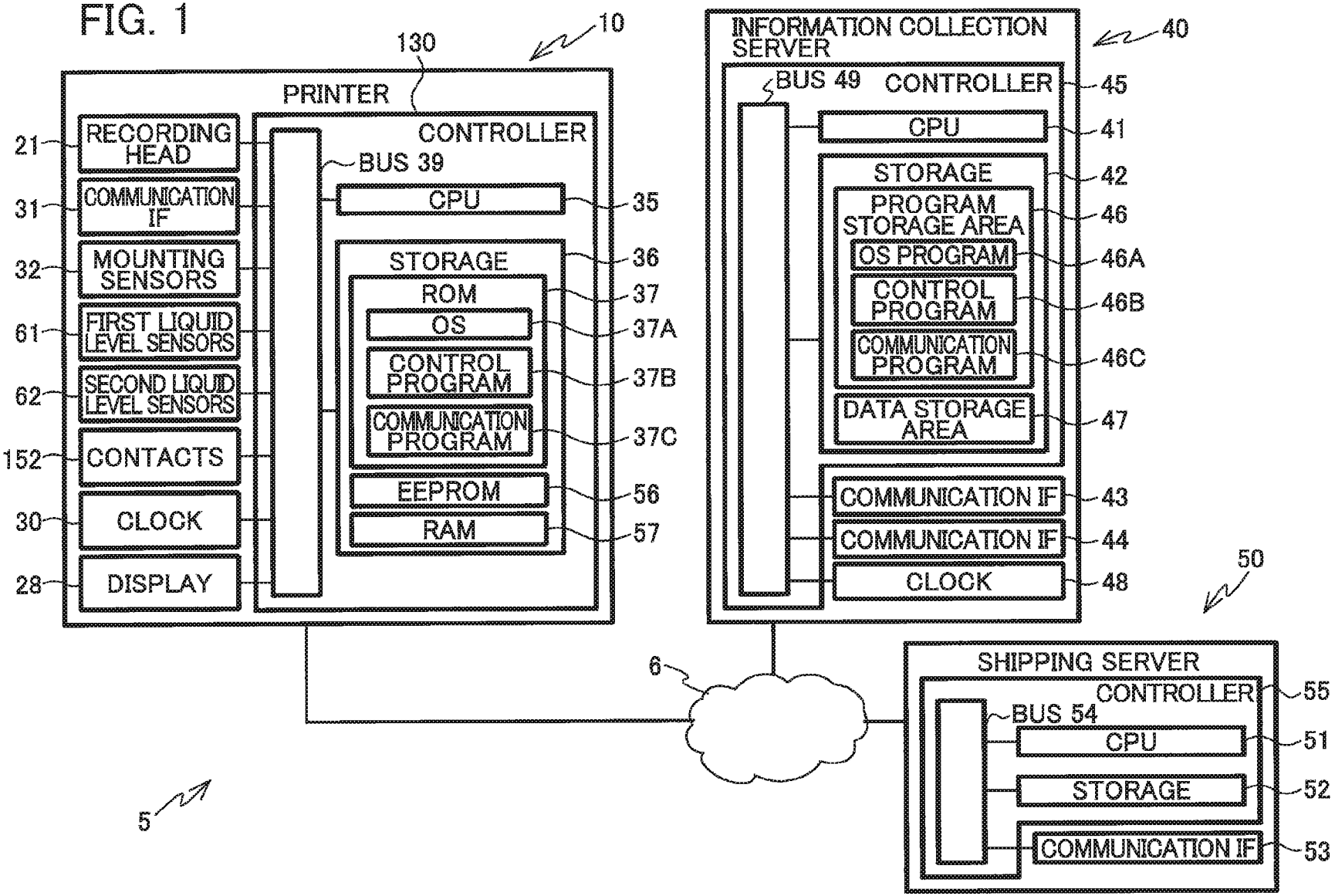
FIG. 1 is a block diagram illustrating a cartridge delivery system having a printer, an information collection server, and a shipping server according to a first embodiment.

FIG. 1 shows a cartridge delivery system 5 according to an embodiment. The cartridge delivery system 5 is provided with one or more printers 10, an information collection server 40 that collects information from the one or more printers 10, and a shipping server 50. The printers 10 are connected to the information collection server 40 by a communication circuit 6, such as the Internet. Each printer 10 and the information collection server 40 can communicate with each other using a communication protocol, such as TCP/IP. The information collection server 40 can send information to the shipping server 50 via the communication circuit 6 such as the Internet, whereby the shipping server 50 receives orders from the information collection server 40. The printer 10 is an example of the image-recording device of the present invention.

Overview of the Printer 10

Figure 2A:
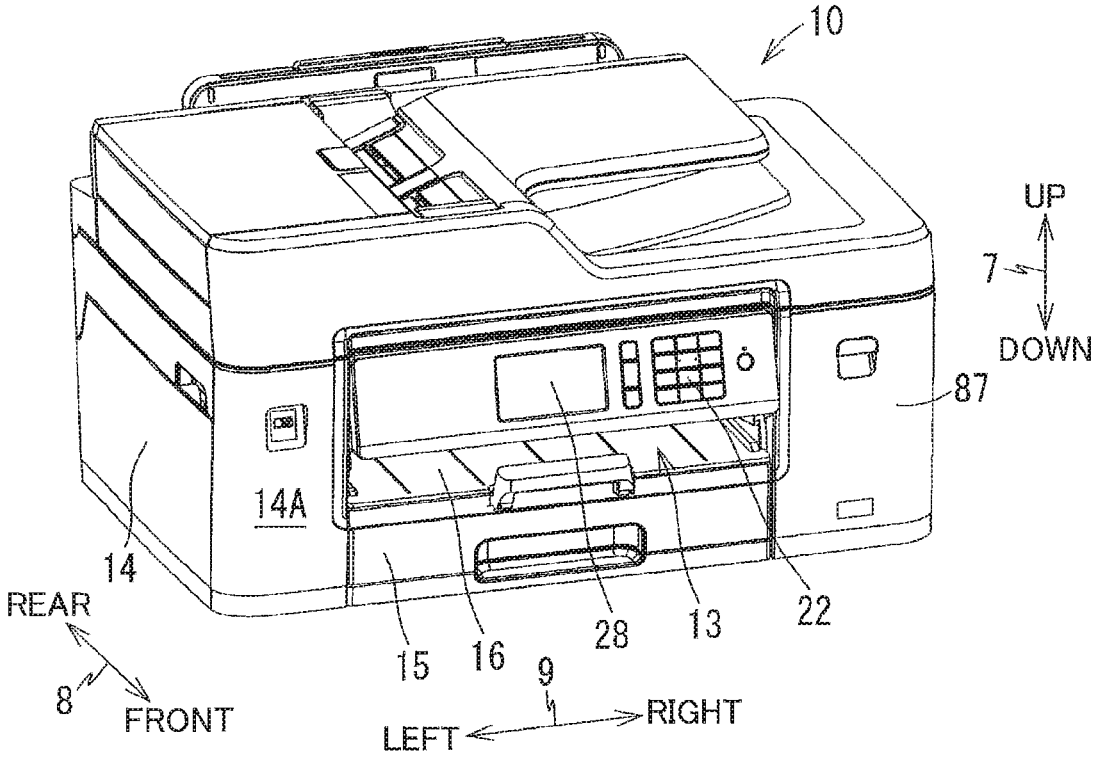
FIG. 2A is a perspective view of a printer according to the first embodiment, and illustrating a closed position of a cover.
Figure 2B:
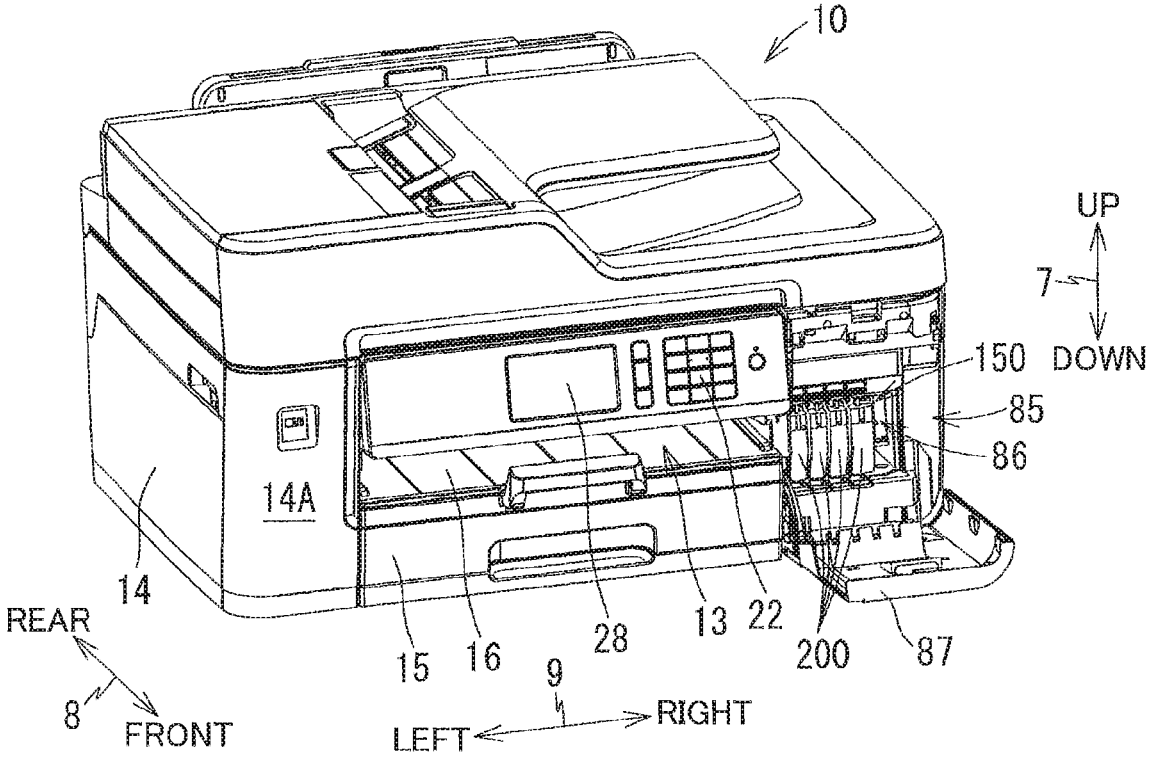
FIG. 2B is a perspective view of the printer according to the first embodiment, and illustrating an open position of the cover.

The printer 10 illustrated in FIGS. 2A and 2B is an inkjet printer that records images on sheets by ejecting ink droplets. The ink is an example of a liquid. The printer 10 may be a multifunction peripheral possessing various functions, such as a facsimile function, a scan function, and a copy function, and the like.

In the following description, front, rear, left, and right directions related to the printer 10 will be referred to as assuming that the printer 10 is disposed on a horizontal plane so as to be operable, as illustrated in FIG. 2A. Note that this posture of the printer 10 illustrated in FIG. 2A will be referred to as an "operable posture". Specifically, an up-down direction 7 of the printer 10 is defined on the basis of the operable posture of the printer 10. A front-rear direction 8 is defined such that a surface of the printer 10 in which an opening 13 is formed constitutes a front surface. A left-right direction 9 is defined on the basis of an assumption that the printer 10 in the operable posture is viewed from its front surface. In other words, in the operable posture of the printer 10, the up-down direction 7 corresponds to a vertical direction, and the front-rear direction 8 and left-right direction 9 correspond to horizontal directions. The front-rear direction 8 and left-right direction 9 are orthogonal to each other.

As illustrated in FIGS. 2A and 2B, the printer 10 is configured with a box-like housing 14 (an example of a mounting body). The opening 13 is formed in a front surface 14A of the housing 14 and is recessed inward into the housing 14. A feed tray 15 is disposed inside the housing 14 in the bottom of the opening 13. The feed tray 15 supports a plurality of sheets in a stacked state. A discharge tray 16 is provided above the feed tray 15. The discharge tray 16 supports sheets that have undergone image recording.

Figure 3:
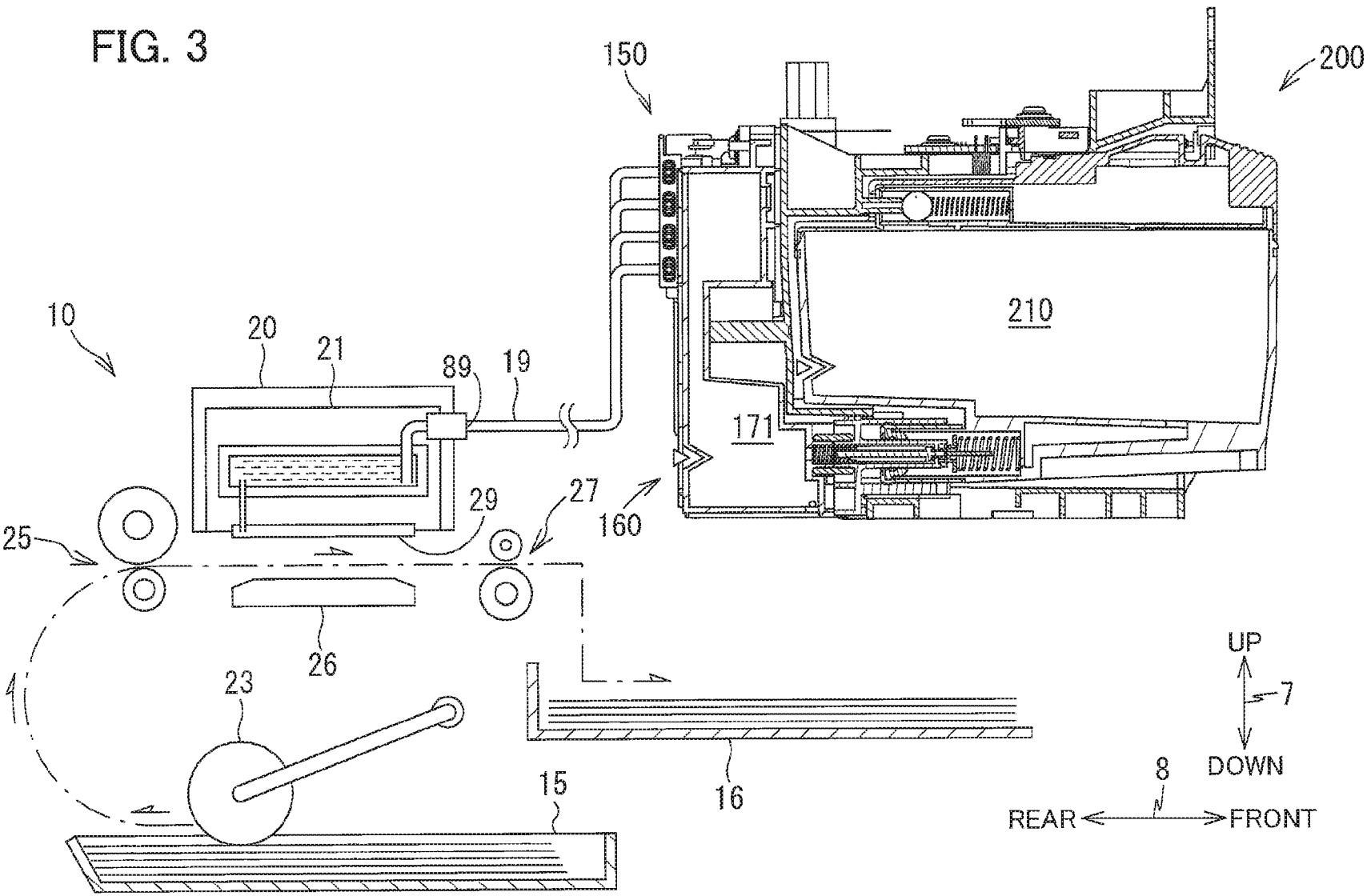
FIG. 3 is a vertical cross-sectional view schematically illustrating an internal configuration of the printer according to the first embodiment.

As illustrated in FIG. 3, a feed roller 23, a pair of conveying rollers 25, a recording head 21 having a plurality of nozzles 29, a platen 26, and a pair of discharge rollers 27 are disposed inside the housing 14. The printer 10 also includes a mounting case 150 and ink tanks 160 that supply ink to the recording head 21 through tubes 19.

The printer 10 drives the feed roller 23 and conveying rollers 25 to convey a sheet from the feed tray 15 to a position over the platen 26 that opposes the recording head 21. Next, the printer 10 controls the recording head 21 to eject through the nozzles 29 ink which is supplied from the ink tank 160 via the tube 19. The ink impacts the sheet supported on the platen 26 to record images on the sheet. Subsequently, the printer 10 drives the discharge rollers 27 to discharge the recorded sheet onto the discharge tray 16.

More specifically, the recording head 21 is supported in a carriage 20. The carriage 20 reciprocates in a main scanning direction (parallel to the left-right direction 9) that crosses the direction that the conveying rollers 25 convey the sheets. A motor (not illustrated) transmits a drive force to the carriage 20 for moving the carriage 20 in the main scanning direction (a direction perpendicular to the surface of the drawing in FIG. 3). While the conveying rollers 25 has halted conveyance of the sheet, the printer 10 moves the carriage 20 in the main scanning direction and controls the recording head 21 to eject ink through the nozzles 29, thereby recording an image in a region constituting the portion of the sheet opposing the recording head 21 (hereinafter also referred to as "one pass"). Next, the printer 10 controls the conveying rollers 25 to convey the sheet so that the next region to be recorded opposes the recording head 21. By repeatedly and alternatingly performing these processes of recording and conveying, the printer 10 records an image on one sheet.

Display 28

As illustrated in FIGS. 2A and 2B, the housing 14 also has a display 28 and an operating panel 22 disposed on the front surface 14A of the housing 14. However, a touchscreen configured of touch sensors arranged over a display panel, or a display panel and push buttons along with or in place of the display 28 and operating panel 22 may be provided on the front surface 14A of the housing 14. The display 28 and the operating panel 22 receives input from the user.

Cover 87

As illustrated in FIG. 2B, an opening 85 is formed in the front surface 14A of the housing 14 at the right end thereof. The housing 14 is also provided with a cover 87. The cover 87 is supported on the housing 14 near the bottom edge of the same and can pivot about a pivot axis extending in the left-right direction 9. The cover 87 is pivotable between a closed position (the position illustrated in FIG. 2A) for covering the opening 95, and an open position (the position illustrated in FIG. 2B) for exposing the opening 85. An accommodating space 86 is formed in the housing 14, expanding into the housing 14 from the opening 85. The mounting case 150 is positioned in the accommodating space 86. Cartridges 200 are detachably mounted in the mounting case 150.

Mounting Case 150

Figure 4:
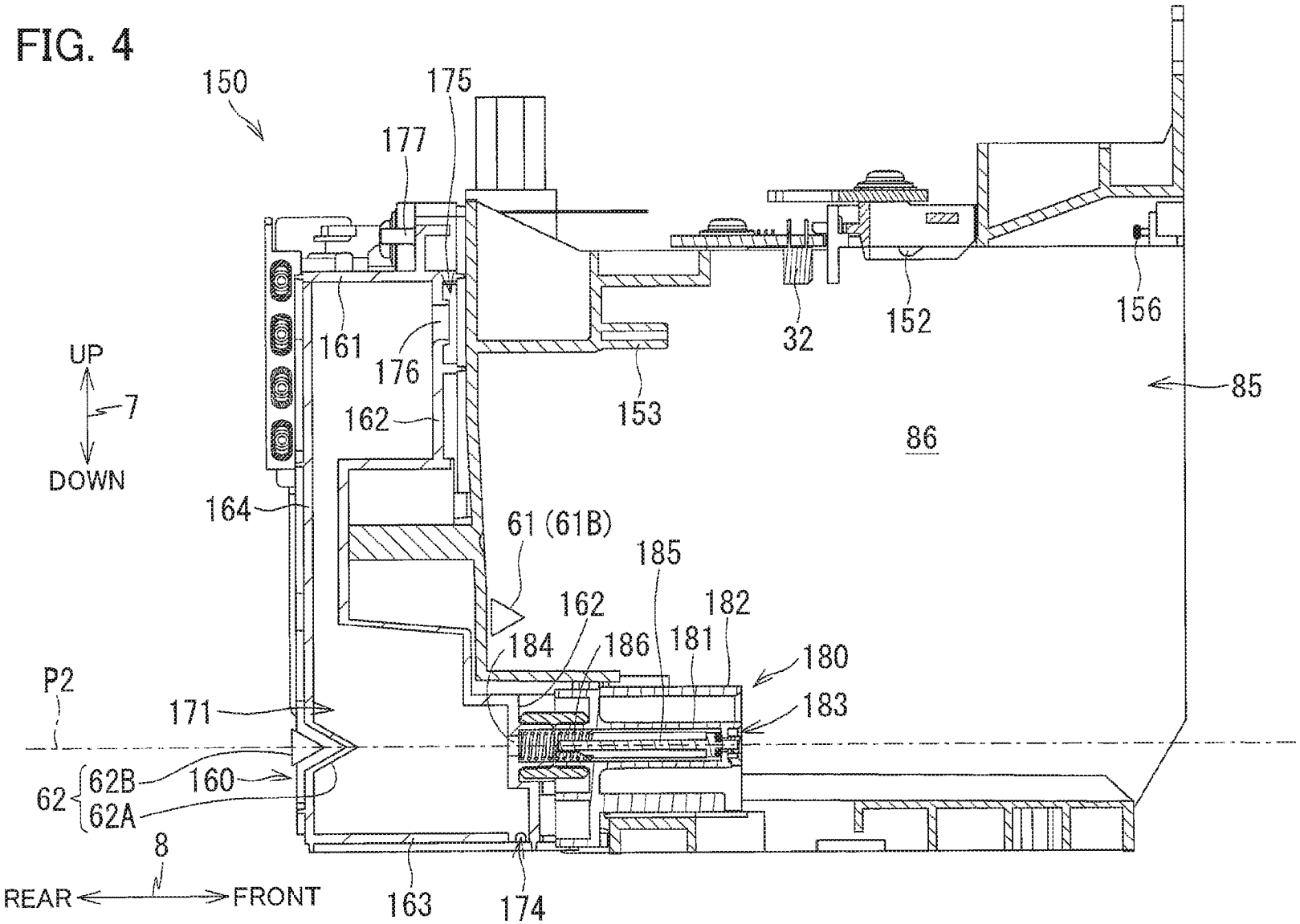
FIG. 4 is a vertical cross-sectional view illustrating a mounting case of the printer according to the first embodiment.

As illustrated in FIG. 4, the mounting case 150 is provided with contacts 152, rods 153, mounting sensors 32, first liquid level sensors 61, light emitting elements 61B and light receiving elements included in second liquid level sensors 62, and a locking pin 156. The mounting case 150 can accommodate four of the cartridges 200 for the corresponding colors black, cyan, magenta, and yellow. In other words, the mounting case 150 is provided with four each of the contacts 152, the rods 153, the mounting sensors 32, the first liquid level sensors 61, and the second liquid level sensors 62 to correspond to the four cartridges 200. Note that the number of cartridges 200 that can be accommodated in the mounting case 150 is not limited to four, but may be one, or five or more.

The mounting case 150 has a box shape with an interior space for accommodating the cartridges 200. The interior space of the mounting case 150 is defined by a top wall enclosing the top side of the interior space, a bottom wall enclosing the bottom side of the interior space, a rear wall enclosing the rear side of the interior space, and a pair of side walls enclosing the left and right sides of the interior space. The opening 85 is formed in the front side of the mounting case 150 opposing the rear wall. In other words, when the cover 87 (FIG. 2B) is placed in the open position, the opening 85 exposes the interior space of the mounting case 150 to the outside of the printer 10.

The cartridges 200 are mounted in the mounting case 150 and removed from the mounting case 150 through the opening 85 formed in the housing 14. More specifically, the cartridges 200 pass through the opening 85 rearward when mounted in the mounting case 150 and pass through the opening 85 forward when removed from the mounting case 150.

Contacts 152

As shown in FIG. 4, the contacts 152 are disposed on the top wall of the mounting case 150. The contacts 152 protrude downward from the top wall into the interior space of the mounting case 150. The contacts 152 are disposed in positions for contacting electrodes 248 (FIG. 5, described later) of the corresponding cartridges 200 when the cartridges 200 are in their mounted states in the mounting case 150. The contacts 152 are electrically conductive and capable of elastically deforming in the up-down direction 7. The contacts 152 are electrically connected to a controller 130 described later.

Rods 153

The rods 153 protrude forward from the rear wall of the mounting case 150. The rods 153 are disposed in positions along the rear wall of the mounting case 150 above corresponding joints 180 (described later). As a cartridge 200 is mounted in the mounting case 150, the corresponding rod 153 is inserted into a corresponding air valve chamber 214 (described later) through a corresponding air communication port 221 (described later) of the cartridge 200. When the rod 153 advances into the air valve chamber 214, the air valve chamber 214 becomes able to communicate with the atmosphere.

Mounting Sensors 32

The mounting sensors 32 (examples of the third sensor) are disposed on the top wall of the mounting case 150 for detecting whether corresponding cartridges 200 are mounted in the mounting case 150. In other words, each mounting sensor 32 is for detecting whether a corresponding cartridge 200 is connected to a corresponding tank 160. Each mounting sensor 32 is provided with a light-emitting part and a light-receiving part that are separated from each other in the left-right direction 9. When a cartridge 200 is mounted in the mounting case 150, a light-blocking rib 245 (FIG. 5) on the cartridge 200 is positioned between the light-emitting part and light-receiving part of the corresponding mounting sensor 32. In other words, the light-emitting part and light-receiving part of the mounting sensor 32 are positioned in a state opposing each other on opposite sides of the light-blocking rib 245 provided on the cartridge 200 mounted in the mounting case 150.

The mounting sensor 32 outputs a different signal (hereinafter called a "mounting signal") depending on whether the light emitted from the light-emitting part in the left-right direction 9 is received by the light-receiving part. The mounting sensor 32 outputs a low level signal (an example of the fifth signal) to the controller 130 when the intensity of light received by the light-receiving part is less than a threshold intensity, for example. The mounting sensor 32 outputs a high level signal (an example of the sixth signal) having a greater signal intensity than the low level signal to the controller 130 when the intensity of light received by the light-receiving part is greater than or equal to the threshold intensity.

Locking Pin 156

The locking pin 156 is a rod-shaped member that extends in the left-right direction 9 through the upper portion of the interior space in the mounting case 150 and near the opening 85. The ends of the locking pin 156 in the left-right direction 9 are fixed in the corresponding side walls of the mounting case 150. The locking pin 156 extends in the left-right direction 9 through the four spaces for accommodating the four cartridges 200. When the cartridges 200 are mounted in the mounting case 150, the locking pin 156 functions to retain the cartridges 200 in their mounted positions illustrated in FIG. 6. The cartridges 200 are fixed to the locking pin 156 when in their mounted states in the mounting case 150.

Ink Tanks 160

The printer 10 is provided with four ink tanks 160 corresponding to the four cartridges 200. Specifically, the printer 10 is provided with an ink tank 160 that accommodates magenta ink to correspond with the cartridge 200 that accommodates magenta ink, an ink tank 160 that accommodates cyan ink to correspond to the cartridge 200 that accommodates cyan ink, an ink tank 160 that accommodates yellow ink to correspond to the cartridge 200 that accommodates yellow ink, and an ink tank 160 that accommodates black ink to correspond to the cartridge 200 that accommodates black ink. Since the four ink tanks 160 share the same general structures, only one of the ink tanks 160 is described below.

The ink tanks 160 are positioned rearward of the rear wall constituting the mounting case 150. Each ink tank 160 is configured of a top wall 161, a front wall 162, a bottom wall 163, a rear wall 164, and a pair of side walls (not illustrated). Note that the front wall 162 is configured of a plurality of walls offset from each other in the front-rear direction 8. A liquid chamber 171 is formed inside each ink tank 160. The liquid chamber 171 is an example of the second tank chamber of the present disclosure.

A prism 62A is provided in the second liquid level sensor 61. The prism 62A constitutes a part of wall of the ink tank 160 at a second position P2 in the up-down direction 7. Light emitted from a light-emitting element 62B provided in the second liquid level sensor 62 can pass through the prism 62A.

At least part of the rear wall 164 may be a film that is affixed to the rear edges of the top wall 161, the bottom wall 163, and the side walls. The side walls of the ink tank 160 may be shared with the side walls of the mounting case 150 or may be provided independently of the mounting case 150. Further, the ink tanks 160 are separated from each other by partitions (not illustrated) disposed between ink tanks 160 neighboring each other in the left-right direction 9.

The liquid chamber 171 is in communication with an ink channel (not illustrated) through an outlet 174 (an example of the second outlet). The bottom end of the outlet 174 is defined in the bottom wall 163 that defines the bottom of the liquid chamber 171. The outlet 174 is positioned lower than a corresponding joint 180 (and specifically, the bottom end of a through-hole 184). The ink channel that communicates with the outlet 174 is also in communication with the corresponding tube 19 (FIG. 3). With this configuration, the liquid chamber 171 communicates with the recording head 21 via the ink channel leading from the outlet 174, and via the tube 19. Hence, ink accommodated in the liquid chamber 171 is supplied to the recording head 21 through the ink channel leading from the outlet 174, and through the tube 19. One end of the ink channel and tube 19 that communicates with the outlet 174 (the end at the outlet 174) is in communication with the liquid chamber 171, while another end 89 (see FIG. 3) is in communication with the recording head 21.

The liquid chamber 171 is in communication with the atmosphere via an air communication chamber 175. More specifically, the air communication chamber 175 is in communication with the liquid chamber 171 via a through-hole 176 that penetrates the front wall 162. The air communication chamber 175 is also in communication with the exterior of the printer 10 through an air communication port 177 and a tube (not illustrated) connected to the air communication port 177. That is, one end of the air communication chamber 175 (the end at the through-hole 176) is in communication with the liquid chamber 171, while the other end (the end at the air communication port 177) is in communication with the exterior of the printer 10. Thus, the air communication chamber 175 communicates with the atmosphere through the air communication port 177 and the tube. The air communication chamber 175 is an example of a second air communication chamber.

Joints 180

As illustrated in FIG. 4, each ink tank 160 is provided with a joint 180. Each joint 180 is provided with a needle 181, and a guide 182. The needle 181 is a tube with a channel formed in the interior thereof. The needle 181 protrudes forward from the front wall 162 defining the liquid chamber 171. An opening 183 is formed in the front end of the needle 181. The interior space of the needle 181 is in communication with the liquid chamber 171 via a through-hole 184 that penetrates the front wall 162. One end of the needle 181 (the end with the opening 183) communicates with the outside of the ink tank 160, and the other end (the end adjacent to the through-hole 184) communicates with the liquid chamber 171. The guide 182 is a cylindrically shaped member arranged around the needle 181. The guide 182 protrudes forward from the front wall 162 and is open on the front end. The thorough-hole 184 is an example of the inlet.

A valve 185 and a coil spring 186 are positioned in the interior space of the needle 181. The valve 185 can move in the front-rear direction 8 within the interior space of the needle 181 between a closed position and an open position. The valve 185 closes the opening 183 when in the closed position and opens the opening 183 when in the open position. The coil spring 186 urges the valve 185 forward, i.e., in a direction for moving the valve 185 from its open position to its closed position.

Second Liquid Level Sensors 62

The second liquid level sensor 62 detects when the level of ink in the liquid chamber 171 has reached the second position P2 using the prism 62A, whose reflectance varies depending on whether ink is in contact therewith.

The second position P2 is the same position in the up-down direction 7 as the axial center of the needle 181 and a center of the through-hole 184. The second position P2 is also at the same position in the up-down direction 7 as the center of an ink supply opening 234 (FIG. 5) described later.

The second liquid level sensors 62 are disposed in the housing 14. Each second liquid level sensor 62 is provided with the prism 62A, the light-emitting portion 62B, and a light-receiving portion (not shown). The light-emitting portion 62B and the light-receiving portion are arranged in confrontation with the prism 62A from the rear side thereof. The light-emitting portion 62B emits light toward the prism 62A. The light-receiving portion receives light emitted from the light-emitting portion 62B and reflected off the prism 62A and outputs a signal to the controller 130 based on the intensity of received light.

When the level of ink stored in the liquid chamber 171 is above the second position P2, the ink contacts the prism 62A in the path of light emitted from the light-emitting portion 62B. At this time, light emitted from the light-emitting portion 62B toward the prism 62A passes through the prism 62A and enters the liquid chamber 171. Hence, the light is not reflected toward the light-receiving portion. Consequently, the light-receiving portion outputs a low level signal (an example of the third signal) to the controller 130. However, when the level of ink stored in the liquid chamber 171 drops to the second position P2 or below, the ink does not contact the prism 62A in the path of light emitted from the light-emitting portion 62B. At this time, light emitted from the light-emitting portion 62B toward the prism 62A is reflected off the prism 62A toward the light-receiving portion. Thus, the light-receiving portion outputs a high level signal (an example of the fourth signal) to the controller 130. In the following description, a low level signal may be indicated by "L" and a high level signal by "H". Note that the light-receiving portion may output a high level signal when the level of ink stored in the liquid chamber 171 is at or above the second position P2, and may output a low level signal when the level of ink is below the second position P2.

Cartridges 200

Figure 5A:
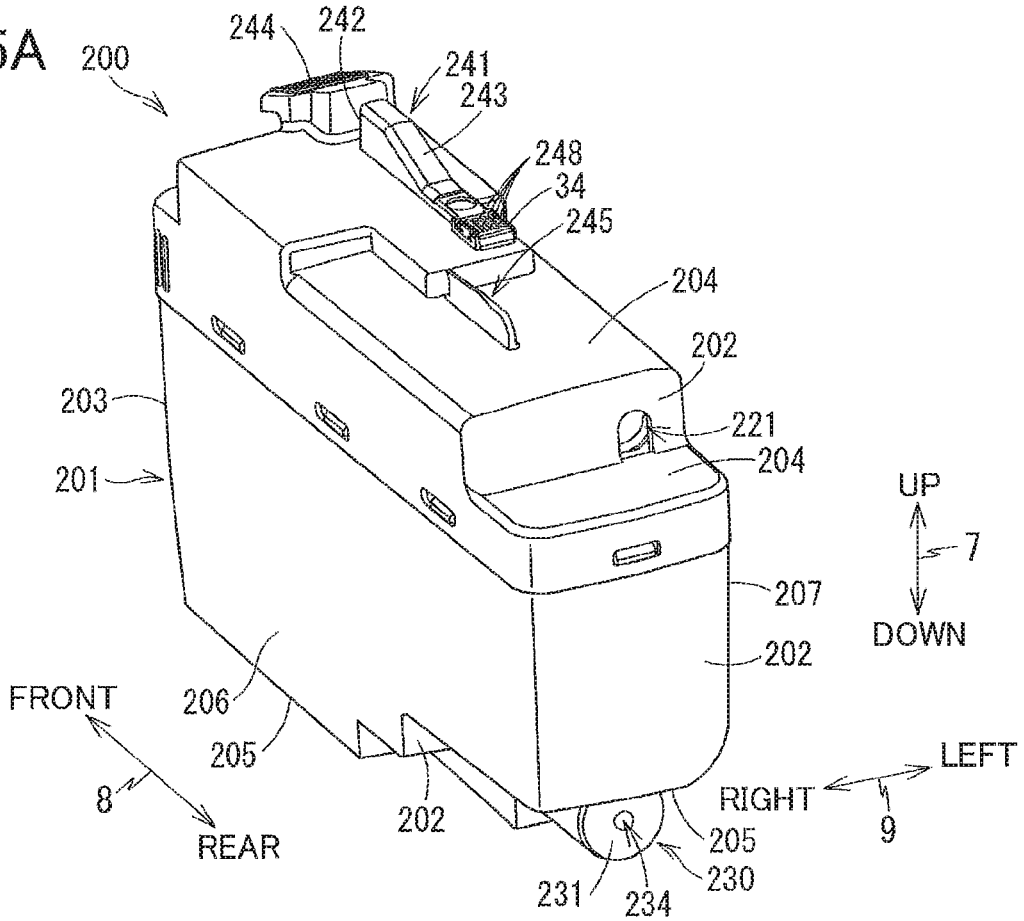
FIG. 5A is a perspective view of a cartridge as viewed from a rear side of the cartridge in the printer according to the first embodiment.
Figure 5B:
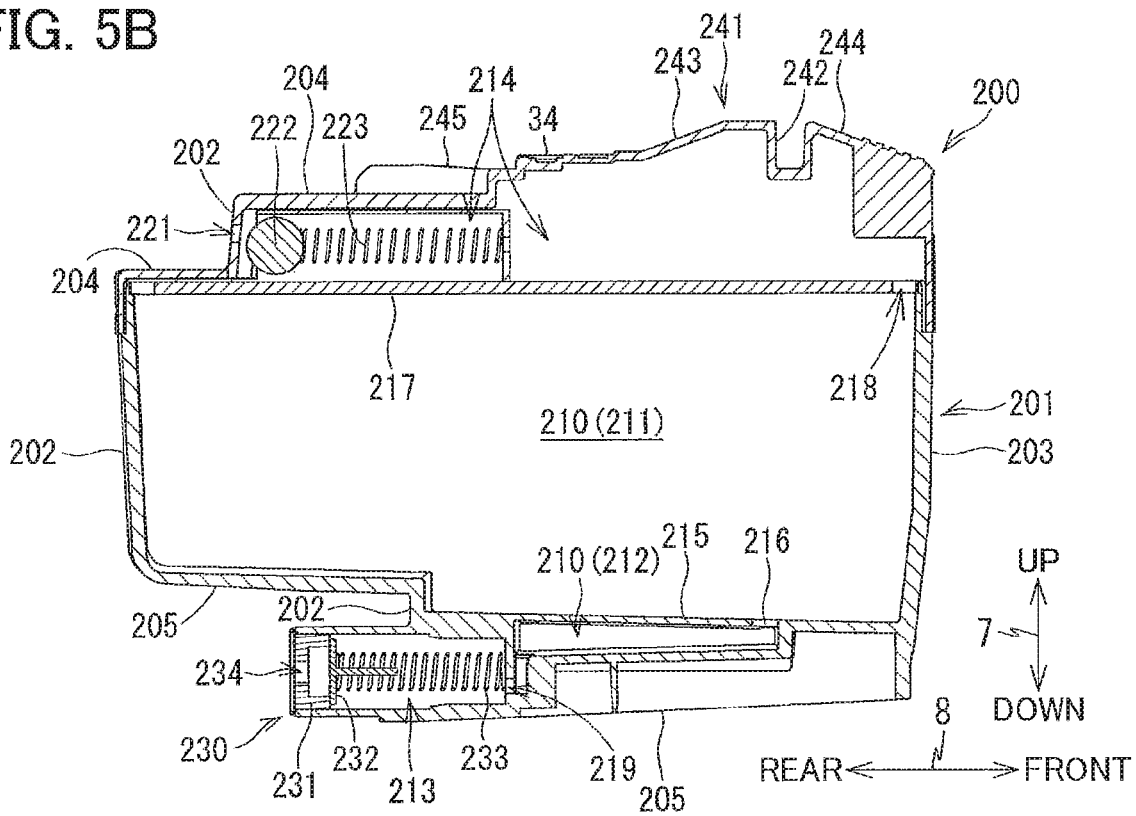
FIG. 5B is a vertical cross-sectional view of the cartridge in the printer according to the first embodiment.

FIGS. 5A and 5B show the structure of a cartridge 200. The cartridge 200 is a receptacle having a liquid chamber 210 (see FIG. 3) that can accommodate a liquid (ink in this example). The liquid chamber 210 is an example of the first liquid chamber.

The liquid chamber 210 is defined by walls formed of a resin material, for example. As illustrated in FIG. 5A, the cartridge 200 is formed in a flattened shape, whereby its dimensions in the up-down direction 7 and the front-rear direction 8 are greater than the dimension in the left-right direction 9. Cartridges 200 that store different colors of ink may be formed in the same external shape or different external shapes. At least a portion of the walls configuring the cartridge 200 is translucent, enabling a user to view the level of ink accommodated in the liquid chamber 210 of the cartridge 200 from the outside.

The cartridge 200 is provided with a housing 201, and an ink supply tube 230. The housing 201 is configured of a rear wall 202, a front wall 203, a top wall 204, a bottom wall 205, and a pair of side walls 206 and 207. Note that the rear wall 202 is configured of a plurality of walls offset from each other in the front-rear direction 8. The top wall 204 is also configured of a plurality of walls that are offset from each other in the up-down direction 7. Similarly, the bottom wall 205 is configured of a plurality of walls that are offset from each other in the up-down direction 7.

As illustrated in FIG. 5B, the liquid chamber 210, an ink valve chamber 213, and an air valve chamber 214 are formed in the interior space of the cartridge 200. The liquid chamber 210 has an upper liquid chamber 211, and a lower liquid chamber 212. The upper liquid chamber 211, the lower liquid chamber 212, and the air valve chamber 214 constitute the interior space of the housing 201. The ink valve chamber 213 constitutes the interior space of the ink supply tube 230. The liquid chamber 210 accommodates ink. The air valve chamber 214 provides communication between the liquid chamber 210 and the exterior of the cartridge 200.

The upper liquid chamber 211 and the lower liquid chamber 212 of the liquid chamber 210 are separated from each other in the up-down direction 7 by a partitioning wall 215 that divides the interior space of the housing 201. The upper liquid chamber 211 and the lower liquid chamber 212 are in communication via a through-hole 216 formed in the partitioning wall 215. The upper liquid chamber 211 and the air valve chamber 214 are separated from each other by a partitioning wall 217 that divides the interior space of the housing 201. The upper liquid chamber 211 and the air valve chamber 214 are in communication with each other via a through-hole 218 formed in the partitioning wall 217. In addition, the ink valve chamber 213 is in communication with the bottom of the lower liquid chamber 212 via a through-hole 219.

In the top of the cartridge 200, the air valve chamber 214 communicates with the outside of the cartridge 200 via an air communication port 221 formed in the rear wall 202. Hence, one end of the air valve chamber 214 (the end near the through-hole 218) communicates with the liquid chamber 210 (and more specifically the upper liquid chamber 211), while the other end (the end at the air communication port 221) communicates with the exterior of the cartridge 200. The air valve chamber 214 is in communication with the atmosphere via the air communication port 221. A valve 222 and a coil spring 223 are also disposed in the air valve chamber 214. The valve 222 can move in the front-rear direction 8 between a closed position and an open position. The valve 222 closes the air communication port 221 when in the closed position and opens the air communication port 221 when in the open position. The coil spring 223 urges the valve 222 rearward, i.e., in a direction for moving the valve 222 from the open position to the closed position. The air valve chamber 214, the valve 222, and the coil spring 223 are examples of the first air communication portion.

As the cartridge 200 is mounted in the mounting case 150, the corresponding rod 153 (FIG. 4) is inserted through the air communication port 221 into the air valve chamber 214. The rod 153 inserted into the air valve chamber 214 moves the valve 222 forward from its closed position against the urging force of the coil spring 223. By moving the valve 222 into the open position, the rod 153 allows the upper liquid chamber 211 to communicate with the atmosphere. Note that the structure for opening the air communication port 221 is not limited to the example described above. As another example, the air communication port 221 may be sealed by a film, and the rod 153 may be configured to puncture the film.

The ink supply tube 230 protrudes rearward from the rear wall 202 at a lower portion of the housing 201. The rear end of the ink supply tube 230 is open. In other words, the ink valve chamber 213 provides communication between the liquid chamber 210 via the through-hole 219 and the outside of the cartridge 200. One end of the ink valve chamber 213 (the end with the through-hole 219) communicates with the liquid chamber 210 (and more specifically the lower liquid chamber 212), and the other end (the end with an ink supply opening 234 described later) communicates with the outside of the cartridge 200. A packing 231, a valve 232, and a coil spring 233 are disposed in the ink valve chamber 213.

An ink supply opening 234 (an example of the first outlet) is formed in the center of the packing 231 and penetrates the packing 231 in the front-rear direction 8. The inner diameter of the ink supply opening 234 is slightly smaller than the outer diameter of the needle 181. The valve 232 is capable of moving in the front-rear direction 8 between a closed position and an open position. When in the closed position, the valve 232 contacts the packing 231 and closes the ink supply opening 234. When in the open position, the valve 232 is separated from the packing 231, opening the ink supply opening 234. The coil spring 233 urges the valve 232 rearward, i.e., in the direction for moving the valve 232 from the open position to the closed position. The urging force of the coil spring 233 is greater than that of the coil spring 186.

As the cartridge 200 is mounted in the mounting case 150, the ink supply tube 230 advances into the guide 182, and the needle 181 gradually passes through the ink supply opening 234 and advances into the ink valve chamber 213. At this time, the needle 181 elastically deforms the packing 231 while closely contacting the inner circumferential surface of the packing 231 defining the ink supply opening 234. When the cartridge 200 is inserted farther into the mounting case 150, the needle 181 moves the valve 232 forward against the urging force of the coil spring 233. At the same time, the valve 232 moves the valve 185, which protrudes in the needle 181 and closed the opening 183, in a rearward direction against the urging force of the coil spring 186.

Through this operation, the ink supply opening 234 and the opening 183 are opened so that the ink valve chamber 213 in the ink supply tube 230 is in communication with the interior space of the needle 181.

Also, by mounting the cartridge 200 in the mounting case 150, a portion of the liquid chamber 210 and a portion of the liquid chamber 171 overlap each other vertically when viewed along a horizontal direction. Further, the bottom of the liquid chamber 171 is positioned lower than the bottom of the liquid chamber 210. Thus, ink accommodated in the liquid chamber 210 flows out from the ink supply opening 234 through the connected ink supply tube 230 and the joint 180 and flows into the liquid chamber 171 of the ink tank 160 from the through-hole 184, owing to the difference in hydraulic head between the liquid chamber 210 and the liquid chamber 171.

The first liquid level sensor 61 detects whether the level of ink in the liquid chamber 171 has reached the first position P1 using a prism 61A (FIG. 6), whose reflectance varies depending on whether ink is in contact therewith.

The second position P1 is a higher position than the second position P2 in the embodiment. The first position P1 is higher than the vertical position of the ink supply opening 234.

Figure 6:
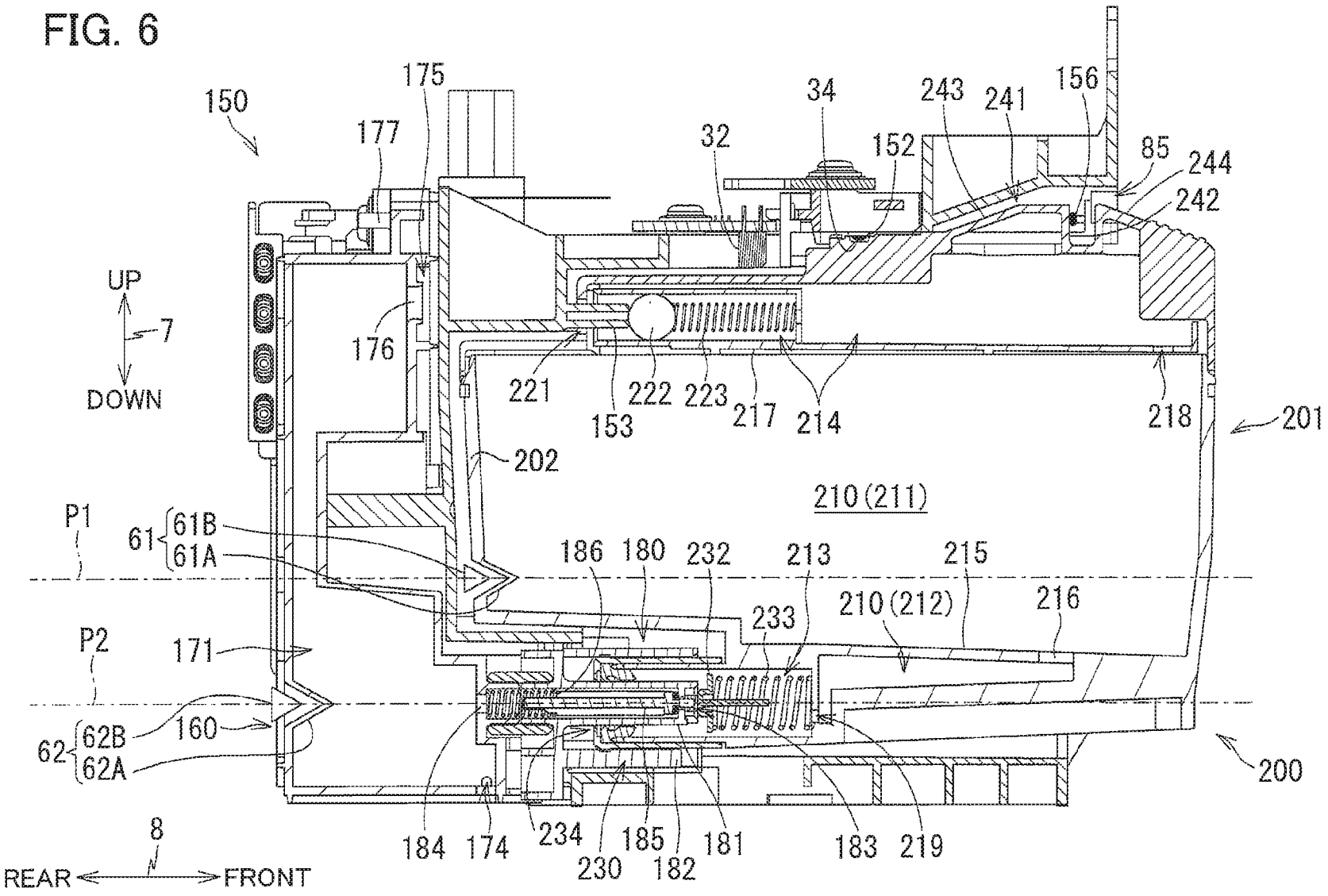
FIG. 6 is a vertical cross-sectional view of the mounting case in which the cartridge is mounted in the printer according to the first embodiment.

As shown in FIG. 6, each first liquid level sensor 61 is provided with the prism 61A, the light-emitting portion 61B, and a light-receiving portion (not shown). The prism 61 is provided in the rear wall 202. The prism 61A is omitted in FIGS. 5A and 5B. The light-emitting portion 61B and the light-receiving portion are arranged in confrontation with the prism 61A from the rear side thereof when the cartridge 200 is mounted to the mounting case 150. The light-emitting portion 61B emits light toward the prism 61A. The light-receiving portion receives light emitted from the light-emitting portion 61B and reflected off the prism 61A and outputs a signal to the controller 130 based on the intensity of received light.

When the level of ink stored in the liquid chamber 171 is higher than the first position P1, the ink contacts the prism 61A in the path of light emitted from the light-emitting portion 61B. At this time, light emitted from the light-emitting portion 61B toward the prism 61A passes through the prism 61A and enters the liquid chamber 210. Hence, the light is not reflected toward the light-receiving portion. Accordingly, the light-receiving portion outputs a low level signal (an example of the first signal) to the controller 130. However, when the level of ink stored in the liquid chamber 210 falls to the first position P1 or below, the ink does not contact the prism 61A in the path of light emitted from the light-emitting portion 61B. Accordingly, light emitted from the light-emitting portion 61B toward the prism 61A is reflected by the prism 61A toward the light-receiving portion. In this case, the light-receiving portion outputs a high level signal (an example of the second signal) to the controller 130. Note that the light-receiving portion may output a high level signal when the level of ink stored in the liquid chamber 171 is at or above the first position P1 and may output a low level signal when the level of ink is below the first position P1.

As illustrated in FIGS. 5A and 5B, a protrusion 241 is formed on the top wall 204. The protrusion 241 protrudes upward from the outer surface of the top wall 204 and extends in the front-rear direction 8. The protrusion 241 has a locking surface 242, and a sloped surface 243. The locking surface 242 and the sloped surface 243 are positioned above the top wall 204. The locking surface 242 faces forward and expands in the up-down direction 7 and the left-right direction 9. In other words, the locking surface 242 is substantially orthogonal to the top wall 204. The sloped surface 243 slopes relative to the top wall 204 so as to face diagonally upward and rearward.

The locking surface 242 is contacted by the locking pin 156 when the cartridge 200 is mounted in the mounting case 150. The sloped surface 243 functions to guide the locking pin 156 into a position for contacting the locking surface 242 as the cartridge 200 is being mounted in the mounting case 150. Through this contact between the locking surface 242 and the locking pin 156, the cartridge 200 is maintained in the mounted position illustrated in FIG. 6 against the urging forces of the coil springs 186, 223, and 233.

A plate-shaped member is formed on the front side of the locking surface 242 and extends upward from the top wall 204. The top surface of this plate-shaped member constitutes an operating part 244 that the user operates in order to extract the cartridge 200 from the mounting case 150. When the cartridge 200 is mounted in the mounting case 150 and the cover 87 is in its open position, the user can operate the operating part 244. When the user presses downward on the operating part 244, the cartridge 200 pivots so that the locking surface 242 moves below the locking pin 156. In this state, the user can extract the cartridge 200 from the mounting case 150.

As illustrated in FIGS. 5A and 5B, a light-blocking rib 245 is formed on the outer surface of the top wall 204 at the rear of the protrusion 241. The light-blocking rib 245 protrudes upward from the outer surface of the top wall 204 and extends in the front-rear direction 8. The light-blocking rib 245 is formed of a material or in a color capable of blocking light outputted from the light-emitting part of the mounting sensor 32. When the cartridge 200 is in its mounted state in the mounting case 150, the light-blocking rib 245 is positioned in the optical path of the light traveling from the light-emitting part to the light-receiving part of the mounting sensor 32. Hence, the mounting sensor 32 outputs a low level signal to the controller 130 (FIG. 1) when the cartridge 200 is mounted in the mounting case 150. Conversely, the mounting sensor 32 outputs a high level signal to the controller 130 when the cartridge 200 is not mounted in the mounting case 150. Therefore, the controller 130 can detect whether a cartridge 200 is mounted in the mounting case 150 according to the mounting signal outputted from the corresponding mounting sensor 32.

As illustrated in FIGS. 5A and 5B, an IC chip 34 is positioned on the outer surface of the top wall 204 between the light-blocking rib 245 and the protrusion 241 in the front-rear direction 8. Electrodes 248 are formed on the IC chip 34. The IC chip 34 is also provided with a memory (not illustrated). The electrodes 248 are electrically connected to the memory on the IC chip 34. The electrodes 248 are exposed on the top surface of the IC chip 34 so as to be capable of conducting electricity with the corresponding contact 152 provided in the mounting case 150. In other words, the electrodes 248 are electrically connected to the contact 152 when the cartridge 200 is mounted in the mounting case 150. The controller 130 can read information from the memory on the IC chip 34 through the contact 152 and the electrodes 248 and can write information to the memory of the IC chip 34 through the contact 152 and the electrodes 248.

The memory on the IC chip 34 stores type information, a serial number, and a cartridge residual quantity for the cartridge 200. The type information indicates whether the cartridge 200 is a small-capacity cartridge or a large-capacity cartridge and indicates the color of ink accommodated therein. The serial number is information that uniquely identifies the cartridge 200. The cartridge residual quantity is a value specifying the quantity of ink accommodated in the cartridge 200. Note that for unused cartridges 200, an initial residual quantity specifying the initial quantity of ink in the cartridge 200 is stored in a memory of the IC chip 34 as the cartridge residual quantity.

Controller 130

The printer 10 is provided with a controller 130. As illustrated in FIG. 1, the controller 130 is provided with a central processing unit (CPU) 35, a storage 36, and a communication bus 39. The storage 36 has a read only memory (ROM) 37, and an electrically erasable programmable read only memory (EEPROM) 56 and a random access memory (RAM) 57 that also store data. The storage 36 is an example of the memory.

The ROM 37 stores an operating system (OS) program 37A, a control program 37B, a communication program 37C, and the like. The OS program 37A functions to control the operations of other programs, such as a printing process. The control program 37B functions to execute processes such as a print process described later. The communication program 37C functions to control communications with external devices such as the information collection server 40 and the like. The OS program 37A is different from the control program 37B, and controls operations different from operations controlled by the communication program 37C. The CPU 35 executes the OS program 37A, the control program 37B, and the communication program 37C by processing commands described at an address. In the following description, operations processed by executing the OS program 37A, the control program 37B, and the communication program 37C may be described as the operations of the controller 130. Note that the controller 130 may possess a hardware circuit that employs chips to implement all or some of the operations executed by the OS program 37A, the control program 37B, and the communication program 37C. The ROM 37 also pre-stores data such as a first prescribed value, a second prescribed value, a third prescribed value, and a fourth prescribed value, and various threshold values described later.

The EEPROM 56 stores device information on the printer 10. The device information includes identification information for the printer 10. The identification information for the printer 10 may be the MAC address, serial number, or the like of the printer 10.

The EEPROM 56 also stores a first discharge value, a second discharge value, an initial cartridge residual quantity as a reference cartridge residual quantity, an initial tank residual quantity as a reference tank residual quantity, an S_Empty flag, a C_Empty flag, a C_NEmpty flag, a transmitted flag, and a consumption rate flag. These values will be described in greater detail in a printing process described later. The transmitted flag is initially set to "OFF". The EEPROM 56 pre-stores a prescribed time, and a prescribed rate.

The RAM 57 stores a tank residual quantity and a cartridge residual quantity described later.

In addition to the components described above, the printer 10 is also provided with a clock 30, a communication interface 31, and a motor (not illustrated). The recording head 21, the communication interface 31, the mounting sensors 32, the first liquid level sensors 61, the liquid level sensors 62, the contacts 152, the clock 30, the display 28, the motor, and the like are all connected to the communication bus 39. The clock 30 outputs date and time information. The communication interface 31 is connected to the communication circuit 6.

The controller 130 drives the motor (not illustrated) through the communication bus 39 to rotate the feed roller 23, the conveying rollers 25, and the discharge rollers 27. The controller 130 also outputs drive signals via the communication bus 39 to driving elements of the recording head 21 in order to control the recording head 21 to eject ink droplets.

The controller 130 detects whether cartridges 200 are mounted in the mounting case 150 according to mounting signals outputted from the mounting sensors 32.

The controller 130 also detects whether the level of ink stored in the liquid chamber 210 is above the first position P1 based on signals outputted from the first liquid level sensor 61. Specifically, when the liquid level signal acquired from the first liquid level sensor 61 is "H", the controller 130 determines that the level of ink stored in the liquid chamber 210 is at or below the first position P1. However, if the liquid level signal is "L", the controller 130 determines that the level of ink is above the first position P1. In addition, when the liquid level signal changes from "L" to "H", the controller 130 determines that the level of ink stored in the liquid chamber 210 has moved downward to a position below or at the first position P1. If the liquid level signal acquired from the first liquid level sensor 61 changes from "H" to "L", the controller 130 determines that the level of ink stored in the liquid chamber 210 has moved upward to a position above the first position P1.

The controller 130 also detects whether the level of ink stored in the liquid chamber 171 is at or above the second position P2 based on signals outputted from the second liquid level sensor 62. Specifically, when the liquid level signal acquired from the second liquid level sensor 62 is "H", the controller 130 determines that the level of ink stored in the liquid chamber 171 is at or below the second position P2. On the other hand, when the liquid level signal is "L", the controller 130 determines that the level of ink is above the second position P2. In addition, if the liquid level signal acquired from the second liquid level sensor 62 changes from "L" to "H", the controller 130 determines that the level of ink stored in the liquid chamber 171 has moved downward to a position below or at the second position P2. If the liquid level signal acquired from the second liquid level sensor 62 changes from "H" to "L", the controller 130 determines that the level of ink stored in the liquid chamber 171 has moved upward to a position above the second position P2.

The controller 130 also reads type information, a serial number, and a cartridge residual quantity stored in the memory of the IC chip 34 through the contacts 152 provided in the mounting case 150 and the electrodes 248 on the cartridge 200 mounted in the mounting case 150. The controller 130 further updates the cartridge residual quantity stored in the memory of the IC chip 34 through the contacts 152 in the mounting case 150 and the electrodes 248 on the cartridge 200 mounted in the mounting case 150.

Information Collection Server 40

The information collection server 40 shown in FIG. 1 may be provided on the communication circuit 6 (the Internet or the like) by the vendor of the printer 10 or a company other than this vendor. The information collection server 40 is provided with a CPU 41, a storage 42, a printer communication interface 43 (hereinafter simply called the "communication interface 43"), a shipping server communication interface 44 (hereinafter simply called the "communication interface 44"), a clock 48, and a communication bus 49. The CPU 41, the storage 42, and the communication bus 49 constitute a controller 45. The clock 48 outputs date and time information. The communication interface 43 is connected to the communication circuit 6 and communicates with the printer 10 and the shipping server 50. The controller 130 of the printer 10 and the controller 45 of the information collection server 40 are examples of the controller.

The storage 42 has a program storage area 46, and a data storage area 47. The program storage area 46 is a hard disk or the like, and the data storage area 47 is RAM, a hard disk, or the like.

The program storage area 46 stores various programs, including an OS program 46A, a control program 46B, and a communication program 46C. The control program 46B executes processes such as an order information transmission process described later. The communication program 46C controls communications with the printer 10 and the shipping server 50. The OS program 46A is different from the control program 46B, and controls operations different from operations controlled by the communication program 46C. The OS program 46A, the control program 46B, and the communication program 46C are copied from the program storage area 46 to data storage area 47 as a series of commands to be executed sequentially by the CPU 41. In the following description, the operations processed by executing the OS program 46A, the control program 46B, and the communication program 46C will be described as the operations of the controller 45 or the information collection server 40.

Shipping Server 50

The shipping server 50 may be established on the communication circuit 6, such as the Internet, by the vendor of the printer 10 or by a company other than the vendor. The shipping server 50 provides a service of shipping cartridges 200 to users of printers 10 in response to requests from the information collection server 40.

The shipping server 50 is provided with a CPU 51, a storage 52, a communication interface 53, and a communication bus 54. The CPU 51, the storage 52, and the communication bus 54 constitute a controller 55. The communication interface 53 communicates with the information collection server 40. The structures of the CPU 51, the storage 52, the communication interface 53, and the communication bus 54 are identical to the structures of the CPU 41, the storage 42, communication interface 43, and the communication bus 49 in the information collection server 40.

Ink Management with the Delivery System 5

In the delivery system 5, the information collection server 40 collects management information from printers 10 that includes information for residual quantity of ink. When the residual quantity of ink becomes low, the information collection server 40 issues an order to the shipping server 50 for a cartridge 200. Since the information collection server 40 can manage residual quantities of ink and order cartridges 200 when needed, this delivery system 5 provides convenience to the user by eliminating the time and effort the users of printers 10 expend to manage residual ink quantities and to purchase cartridges 200.

Specifically, the user of each printer 10 enters a contract with the manufacturer that provides a service to manage residual ink quantities and to place orders for cartridges 200. A contract for this ink management and cartridge ordering service is entered for each printer. When a contract is entered, the user's information and identification information for the printer 10 under contract is registered in the information collection server 40. The user information is information relevant to the shipping destination of the cartridges 200, such as the user's name and address. The identification information is information for identifying an individual printer 10 under contract, such as, a serial number and a MAC address.

The identification information for the printer 10 and the user information are registered in the information collection server 40 in association with each other. The processes performed on the printer 10, the information collection server 40, and the shipping server 50 in relation to the ordering of cartridges 200 will be described below in greater detail.

Processes Executed by the Controller 130 of the Printer 10

Next, processes executed by the controller 130 of the printer 10 will be described with reference to flowcharts shown in FIGS. 7, and 9-12 and a table shown in FIG. 8. Note that the order in which the steps described below are executed may be modified as desired without departing from the spirit of the present disclosure.

Printing Process

Figure 7:
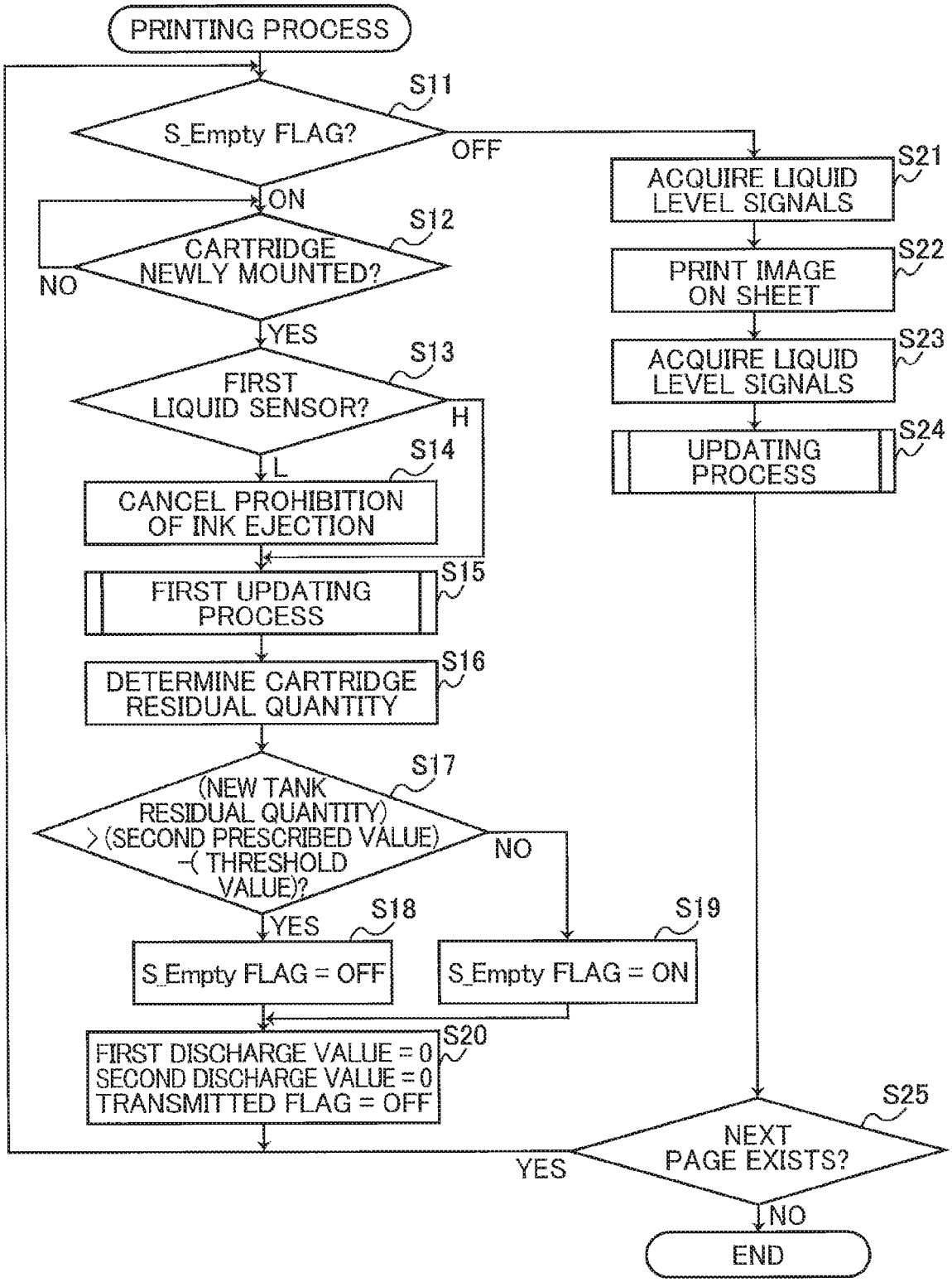
FIG. 7 is a flowchart illustrating steps in a printing process executed by a controller of the printer according to the first embodiment.

The controller 130 executes the printing process illustrated in FIG. 7 when a print command is inputted into the printer 10. While there is no particular restriction on the source of the print command, the controller 130 may receive user operations for a print command through the operating panel 22 or the display 28 (FIG. 2), or may receive user operations for a print command from an external device via the communication interface 31. The print command includes image data representing an image to be printed. The controller 130 stores the image data in the RAM 57 of the printer 10.

In S11 at the beginning of the printing process, the controller 130 determines whether the value of the S_Empty flag is "ON" or "OFF." The controller 130 sets the S_Empty flag in the EEPROM 56 to "ON" prior to the level of ink in the liquid chamber 171 of the corresponding ink tank 160 dropping to the top of the outlet 174 through which ink flows out of the ink tank 160. Before the controller 130 sets the S_Empty flag to "ON," the S_Empty flag stored in the EEPROM 56 is set to an initial value of "OFF." Note that there is a possibility that air could enter the nozzles of the recording head 21 after the level of ink reaches the top of the outlet 174. If air were to enter the nozzles in the recording head 21 and become retained therein, the retained air could obstruct the flow of ink into the nozzles or obstruct the ejection of ink droplets from the nozzles.

Hence, the S_Empty flag serves to prevent air from being introduced into the nozzles of the recording head 21. As will be described later, the controller 130 sets the S_Empty flag in the EEPROM 56 to "OFF" in step S18 and sets the S_Empty flag to "ON" in steps S19 and S65 (FIG. 10D). Although not illustrated in the flowchart, the controller 130 prohibits the ejection of ink from the recording head 21 when the S_Empty flag is set to "ON" and allows the ejection of ink when the S_Empty flag is set to "OFF."

If the controller 130 determines in S11 that the S_Empty flag is set to the value "ON" (S11: ON), the controller 130 begins acquiring the mounting signal from the corresponding mounting sensor 32 at prescribed intervals. In S12 the controller 130 determines whether the acquired mounting signal changed from a low level signal (hereinafter simply called "L") to a high level signal (hereinafter simply called "H") and whether the mounting signal subsequently changed from "H" to "L". That is, the controller 130 determines whether a cartridge 200 was newly mounted on the basis of changes in the mounting signal. In the following description, the controller 130 determining whether the acquired mounting signal changed from "L" to "H" and subsequently from "H" to "L" will be described as the controller 130 determining whether the cartridge 200 has been replaced. Further, the controller 130 will determine that a cartridge 200 has been mounted (that is, a cartridge 200 has been replaced with the previous cartridge 200) when determining in S12 that the acquired mounting signal changed from "L" to "H" and subsequently changed from "H" to "L" (S12: YES).

While a cartridge 200 has not been mounted (that is, while a cartridge 200 has not been replaced with the previous cartridge 200) (S12: NO), the controller 130 continues periodically acquiring the mounting signal from the mounting sensor 32.

After determining that a cartridge 200 was mounted (or replaced) (S12: YES), the controller 130 determines whether to cancel the prohibition on ink ejection from the recording head 21. This will be described below in greater detail. If a cartridge 200 is mounted (S12) while ink ejection from the recording head 21 is prohibited (while the S_Empty flag is set to the value "ON"; S11: ON), in S13 the controller 130 references the liquid level signal acquired from the first liquid level sensor 61. If the liquid level signal is "L" (S13: L), the controller 130 determines that the liquid chamber 210 in the newly mounted cartridge 200 stores a sufficient quantity of ink for the level of ink to reach a height at or above the first position P1. In this case, in S14 the controller 130 sets the value of the S_Empty flag to "OFF", thereby canceling the prohibition of ink ejection from the recording head 21, i.e., thereby allowing the ejection of ink from the recording head 21. However, if the liquid level signal from the second liquid level sensor 62 is "H", the controller 130 continues prohibiting ink ejection from the recording head 21. In this case, the prohibition of ink ejection from the recording head 21 can only be canceled on the condition that the value of the S_Empty flag is set to "OFF" in S16 or S18.

After the controller 130 determines whether to cancel the prohibition on ink ejection from the recording head 21, in S15 the controller 130 executes a first updating process. Note that while the process in S12 is given as an example by which the controller 130 determines whether a cartridge 200 has been mounted, the determination is not limited to this process. For example, the controller 130 may determine whether a cartridge 200 has been mounted on the basis of a serial number. In this case, the controller 130 reads the serial number of a cartridge 200 from the memory on the IC chip 34 of the cartridge 200. Subsequently, the controller 130 determines whether the serial number read from the memory matches a serial number stored in the EEPROM 56. The serial numbers stored in the EEPROM 56 are those serial numbers stored in the memory of IC chips 34 disposed on cartridges 200 (previous cartridges 200) that were mounted in the mounting case 150 prior to a new cartridge 200 being mounted in the mounting case 150. Thus, in this case the controller 130 determines that a cartridge 200 has been mounted when the serial number read from the memory of the IC chip 34 does not match a serial number stored on the EEPROM 56.

First Updating Process

Figure 10A:
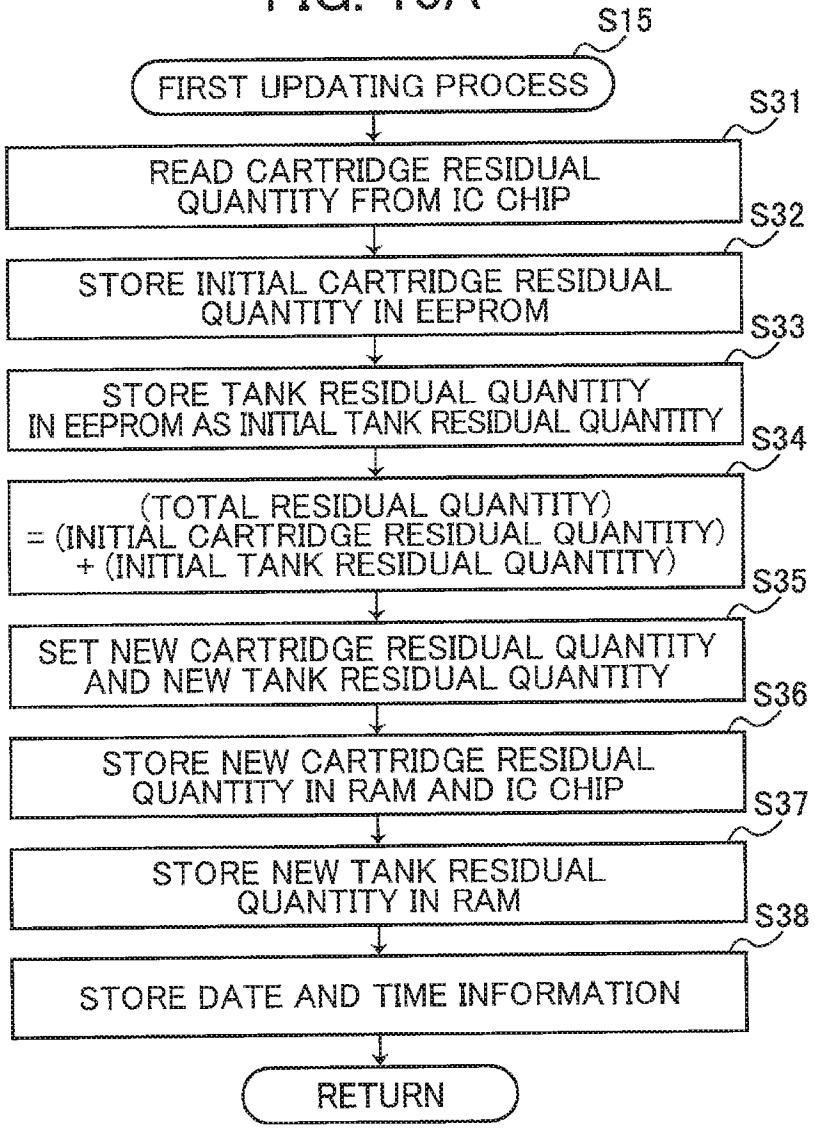
FIG. 10A is a flowchart illustrating steps in a first updating process executed by the controller of the printer.

The controller 130 executes the first updating process illustrated in FIG. 10A so as to update the initial cartridge residual quantity and the initial tank residual quantity stored in the EEPROM 56 and the cartridge residual quantity sored in the IC chip 34 on a cartridge 200.

In S31 at the beginning of the first updating process, the controller 130 reads the cartridge residual quantity from the memory on the IC chip 34 of the cartridge 200 mounted in the mounting case 150 through the contact 152. In S32 the controller 130 stores the cartridge residual quantity read in S31 in the EEPROM 56 as the initial cartridge residual quantity.

In S33 the controller 130 reads a tank residual quantity from the RAM 57. Note that if a tank residual quantity is not stored in the RAM 57 due to an interruption in power supply or the like, the controller 130 calculates a tank residual quantity and stores this calculated value in the RAM 57, similar to a fourth updating process described later. The tank residual quantity read from the RAM 57 indicates the residual quantity of ink accumulated in the liquid chamber 171 of the ink tank 160 just prior to the cartridge 200 being mounted. In other words, the tank residual quantity indicates the quantity of ink that had accumulated in the liquid chamber 171 of the ink tank 160 when the previous cartridge 200 was removed. In S33 the controller 130 stores the tank residual quantity read from the RAM 57 in the EEPROM 56 as the initial tank residual quantity.

In S34 the controller 130 adds the initial cartridge residual quantity and the initial tank residual quantity to calculate a total residual quantity specifying the total quantity of residual ink. The total residual quantity denotes the sum of the residual ink quantity in the liquid chamber 210 and the residual ink quantity in the liquid chamber 171. The total residual quantity is an example of the total liquid quantity. The controller 130 stores the total residual quantity in the EEPROM 56. The total residual quantity may be stored in the RAM 57 or may be calculated as needed from the cartridge residual quantity and the tank residual quantity stored in the RAM 57. In S35 the controller 130 sets a new cartridge residual quantity and new tank residual quantity based on the calculated total residual quantity.

To describe this in greater detail, a portion of the ink accommodated in the liquid chamber 210 of the cartridge 200 flows out of the liquid chamber 210 into the liquid chamber 171 of the ink tank 160 when a new cartridge 200 is mounted in the mounting case 150. This flow of ink from the liquid chamber 210 of the cartridge 200 into the liquid chamber 171 of the ink tank 160 stops when the difference in the hydraulic head between ink accommodated in the liquid chamber 210 and ink accommodated in the liquid chamber 171 becomes negligible. The new cartridge residual quantity and the new tank residual quantity denote residual ink quantities when there is little difference in hydraulic head between ink accommodated in the liquid chamber 210 of the cartridge 200 and ink accommodated in the liquid chamber 171 of the ink tank 160.

The controller 130 may calculate the cartridge residual quantity and the tank residual quantity based on formulae stored in the EEPROM 56 or the ROM 37, for example. Alternatively, the controller 130 may set the cartridge residual quantity and the tank residual quantity based on tables stored in the EEPROM 56 and the ROM 37, for example. More specifically, the shape of the liquid chamber 210 in the cartridge 200 and the shape of the liquid chamber 171 in the ink tank 160 are predetermined according to design. Therefore, by knowing the total residual quantity of ink, it is also possible to determine the cartridge residual quantity and the tank residual quantity when the hydraulic head difference between ink accommodated in the cartridge 200 and ink accommodated in the ink tank 160 is almost nothing. Thus, formulae for calculating the cartridge residual quantity and the tank residual quantity from a total residual quantity are pre-stored in the EEPROM 56 or the ROM 37. Alternatively, tables showing correlations between cartridge residual quantities and tank residual quantities, and total residual quantities may be pre-stored in the EEPROM 56 or the ROM 37. The controller 130 sets (obtains) a new cartridge residual quantity and a new tank residual quantity based on the total residual quantity of ink and the formulae or tables.

In S36 the controller 130 stores the new cartridge residual quantity set in S35 in the RAM 57 and updates the cartridge residual quantity stored in the memory of the IC chip 34 to the new cartridge residual quantity. In S37 the controller 130 stores the new tank residual quantity set in S35 in the RAM 57. The controller may further store the new cartridge residual quantity as the initial cartridge residual quantity and the new tank residual quantity as the initial tank residual quantity in the EEPROM 56. In S38 the controller 130 stores date and time information outputted by the clock 30 in the EEPROM 56 as a mounted date and time, and ends the first updating process.

After completing the first updating process of S15 in FIG. 7, in S16 the controller 130 executes a process to determine the cartridge residual quantity.

In the process for determining the cartridge residual quantity, the controller 130 stores "ON" or "OFF" in a C_Empty flag and a C_NEmpty flag. The controller 130 keeps the S_Empty flag at "ON" when the liquid level signal acquired from the second liquid level sensor 62 remains "H", and records "OFF" in the S_Empty flag when the liquid level signal acquired from the second liquid level sensor 62 is "L" or has changed to "L".

The C_Empty flag serves to indicate when ink is no longer accommodated in the liquid chamber 210 of the cartridge 200. The value "ON" is stored in the C_Empty flag when ink is not accommodated in the liquid chamber 210, and the value "OFF" is stored in the C_Empty flag when ink is accommodated in the liquid chamber 210. When the liquid level signal acquired from the second liquid level sensor 62 is "L", in the first embodiment the controller 130 determines that ink is accommodated in the liquid chamber 210 and records the value "OFF" in the C_Empty flag. However, when the liquid level signal acquired from the second liquid level sensor 62 is "H", the controller 130 determines that ink is not stored in the liquid chamber 210 and records the value "ON" in the C_Empty flag.

The C_NEmpty flag serves to indicate that the quantity of ink remaining in the liquid chamber 210 of the cartridge 200 is low. The value "ON" is stored in the C_NEmpty flag when the residual quantity of ink in the liquid chamber 210 is low, and the value "OFF" is stored in the C_NEmpty flag when the residual quantity of ink in the liquid chamber 210 is not low. When the liquid level signal acquired from the first liquid level sensor 61 is "L", in the first embodiment the controller 130 determines that the residual quantity of ink in the liquid chamber 210 is not low and records the value "OFF" in the C_NEmpty flag. However, when the liquid level signal acquired from the first liquid level sensor 61 is "H", the controller 130 determines that the residual quantity of ink in the liquid chamber 210 is low and records the value "ON" in the C_NEmpty flag.

In the process for determining the cartridge residual quantity, results are determined and the values "ON" or "OFF" are stored in the C_Empty flag and the C_NEmpty flag according to the table in FIG. 8. That is, the controller 130 references liquid level signals acquired from the first liquid level sensor 61 and the second liquid level sensor 62 during a prescribed period for mounting the cartridge 200, determines mounting results for the cartridge 200 based on the referenced liquid level signals, and stores "ON" or "OFF" in the C_Empty flag and C_NEmpty flag according to these results.

The prescribed period for mounting the cartridge 200 is a period beginning prior to the cartridge 200 being mounted and lasting a prescribed length of time after the cartridge 200 is mounted, for example. Since the difference in the hydraulic head between ink accommodated in the liquid chamber 210 and ink accommodated in the liquid chamber 171 causes ink to flow between the liquid chamber 210 and the liquid chamber 171, the prescribed length of time is set to a duration after the cartridge 200 is mounted that is sufficient for the ink levels in the liquid chamber 210 and the liquid chamber 171 to become equal. The controller 130 may determine mounting results for the cartridge 200 by comparing liquid level signals acquired from the first liquid level sensor 61 and the second liquid level sensor 62 at a start time of the prescribed period with those signals acquired at an end time of the prescribed period.

Results of mounting the cartridge 200 will be described next in greater detail with reference to FIG. 8. The controller 130 determines that a normal cartridge 200 with a large residual quantity of ink (a new cartridge 200, for example) has been mounted, and records the value "OFF" in both the C_Empty flag and C_NEmpty flag in the following two cases: when the liquid level signal acquired from the first liquid level sensor 61 is kept to "L" and the liquid level signal acquired from the second liquid level sensor 62 is kept to "L" during the prescribed period for mounting the cartridge 200; and when the liquid level signal acquired from the first liquid level sensor 61 is kept to "L" and the liquid level signal acquired from the second liquid level sensor 62 changed from "H" to "L" during the prescribed period for mounting the cartridge 200. Here, the phrases such as "during the prescribed period, the signal is kept to "L" includes not only a situation that the detected signal is always "L", but also situations such as a situation that the detected signal is almost "L" excluding short periods and a situation that the detected signal is "L" at a start time part of the prescribed period and the detected signal is "L" at an end time part of the prescribed period. The same holds true in the following description.

The controller 130 determines that a cartridge 200 having a low residual quantity of ink (i.e., a used cartridge 200) has been mounted and stores the value "OFF" in the C_Empty flag and the value "ON" in the C_NEmpty flag in the following four cases: when the liquid level signal acquired from the first liquid level sensor 61 is kept to "H" and the liquid level signal acquired from the second liquid level sensor 62 is kept to "L" during the prescribed period for mounting the cartridge 200; when the liquid level signal acquired from the first liquid level sensor 61 is kept to "H" and the liquid level signal acquired from the second liquid level sensor 62 changed from "H" to "L" during the prescribed period for mounting the cartridge 200; when the liquid level signal acquired from the first liquid level sensor 61 changed from "L" to "H" and the liquid level signal acquired from the second liquid level sensor 62 is kept to "L" during the prescribed period for mounting the cartridge 200; and when the liquid level signal acquired from the first liquid level sensor 61 changed from "L" to "H" and the liquid level signal acquired from the second liquid level sensor 62 changed from "H" to "L" during the prescribed period for mounting the cartridge 200.

The controller 130 determines that an empty cartridge 200 storing no ink (i.e., a used cartridge 200) was mounted and stores the value "ON" in both the C_Empty flag and C_NEmpty flag in the following two cases: when the liquid level signal acquired from the first liquid level sensor 61 is kept to "H" and the liquid level signal acquired from the second liquid level sensor 62 is kept to "H" during the prescribed period for mounting the cartridge 200; and when the liquid level signal acquired from the first liquid level sensor 61 changed from "L" to "H" and the liquid level signal acquired from the second liquid level sensor 62 is kept to "H" during the prescribed period for mounting the cartridge 200.

If the liquid level signal acquired from the first liquid level sensor 61 changed from "H" to "L" and the liquid level signal acquired from the second liquid level sensor 62 is kept to "L" during the prescribed period for mounting the cartridge 200, the controller 130 determines that ink flowed upstream from the liquid chamber 171 to the liquid chamber 210 when the cartridge 200 was mounted. In this case, the controller 130 stores the value "OFF" in both the C_Empty flag and the C_NEmpty flag. In addition, the controller 130 maintains the value of the S_Empty flag at "ON" when the liquid level signal acquired from the second liquid level sensor 62 remains unchanged at "H", but records the value "OFF" in the S_Empty flag when the liquid level signal acquired from the second liquid level sensor 62 is kept to "L" or changed to "L".

If the liquid level signals acquired from the first liquid level sensor 61 and the second liquid level sensor 62 during the prescribed period for mounting the cartridge 200 are any other pattern than the patterns described above, the controller 130 determines that at least one of the first liquid level sensor 61 and the second liquid level sensor 62 has malfunctioned. In this case, the controller 130 also issues a notification indicating that at least one sensor has malfunctioned. Specifically, the controller 130 displays an image on the display 28 indicating that the sensor(s) malfunctioned. A notification issued by the controller 130 signifies that the controller 130 controls the display 28 (or a speaker, LED, or the like described later) to notify the user. The notification of a sensor malfunction is continued until the malfunctioning sensor has been replaced with a normally operating sensor, for example.

The printer 10 may also be provided with a speaker in place of or together with the display 28. In this case, the controller 130 performs the above notification by outputting a warning sound to the speaker. The printer 10 may also be provided with lamps, such as LEDs, in place of or together with the display 28. In this case, the controller 130 performs the above notification by lighting or flashing the LEDs or other lamps. This ability to perform notifications on devices other than the display 28 also applies to other notifications described later.

When the value "ON" is stored in the C_Empty flag in the process for determining the cartridge residual quantity, the controller 130 issues a cartridge empty notification indicating that the liquid chamber 210 of the cartridge 200 does not store any ink. Specifically, the controller 130 displays a cartridge empty image on the display 28 specifying that the liquid chamber 210 of the corresponding cartridge 200 has run out of ink and prompting the user to replace the cartridge 200. This cartridge empty notification is continued until the value "OFF" has been stored in the C_Empty flag provided in the EEPROM 56.

When the value "ON" is stored in the C_NEmpty flag in the process for determining the cartridge residual quantity, the controller 130 issues a cartridge near-empty notification indicating that the residual quantity of ink stored in the liquid chamber 210 of the cartridge 200 is low. Specifically, the controller 130 displays a cartridge near-empty image on the display 28 specifying that the ink stored in the liquid chamber 210 of the cartridge 200 is low. Note that the cartridge near-empty notification is continued until the value "OFF" has been stored in the C_NEmpty flag provided in the EEPROM 56.

When the value "ON" is stored in both the C_Empty flag and the C_NEmpty flag, the controller 130 issues a cartridge empty notification and not a cartridge near-empty notification.

When the controller 130 determines that ink has flowed upstream from the liquid chamber 171 into the liquid chamber 210 in the process for determining the cartridge residual quantity, the controller 130 issues a notification through the display 28 or the like indicating this information.

After completing the process for determining the cartridge residual quantity in S16 shown in FIG. 7, the controller 130 executes a process for determining the tank residual quantity (S17-S19). In this process, the controller 130 determines the residual quantity of ink stored in the liquid chamber 171 and records the value "ON" or "OFF" in the S_Empty flag based on the determination results.

In S17 the controller 130 determines whether the new tank residual quantity stored in the RAM 57 (S37) in the first updating process (S15) is greater than a value obtained by subtracting a threshold value from a second prescribed value. The second prescribed value is a value specifying the quantity of ink stored in the liquid chamber 171 of the ink tank 160 when the ink level is at the second position P2. The second prescribed value is pre-stored in the ROM 37, for example. The threshold values will be described later in greater detail.

When the new tank residual quantity is greater than the value obtained by subtracting the threshold value from the second prescribed value (S17: YES), the level of ink stored in the liquid chamber 171 of the ink tank 160 is at a position slightly higher than the outlet 174. Since air cannot enter the nozzles of the recording head 21 at this time, in S18 the controller 130 stores the value "OFF" in the S_Empty flag.

However, if the new tank residual quantity is less than or equal to the value obtained by subtracting the threshold value from the second prescribed value (S17: NO), the level of ink stored in the liquid chamber 171 of the ink tank 160 is at or below the outlet 174. Since there is a chance that air could enter the nozzles of the recording head 21 at this time, in S19 the controller 130 stores the value "ON" in the S_Empty flag.

When the value "ON" has been stored in the S_Empty flag in the process for determining the tank residual quantity, the controller 130 issues a tank empty notification indicating that no ink is stored in the liquid chamber 171 of the ink tank 160. Specifically, the controller 130 displays a tank empty image on the display 28 specifying that the liquid chamber 171 of the ink tank 160 stores no ink (and prompting the user to mount a new cartridge 200). This tank empty notification is maintained until the value "OFF" is stored in the S_Empty flag provided in the EEPROM 56.

After completing the process for determining the tank residual quantity (S17-S19), in S20 the controller 130 stores a "0" in the EEPROM 56 as the first discharge value and a "0" as the second discharge value, and stores the value "OFF" in a transmitted flag provided in the EEPROM 56. After executing the process in S20, the controller 130 repeats the above process from S11. The first discharge value, the second discharge value, and the transmitted flag will be described later.

On the other hand, if the controller 130 determines in S11 that the value of the S_Empty flag stored in the EEPROM 56 is "OFF" (S11: OFF), in S21 the controller 130 acquires liquid level signals from the first liquid level sensor 61 and the second liquid level sensor 62. In S22 the controller 130 performs a print on one or more sheets according to image data stored in the RAM 57. As images are printed on one or more sheets, ink is ejected from the recording head 21. As ink is ejected, the level of ink in the ink tank 160 drops. After completing the print in S22, in S23 the controller 130 acquires liquid level signals from the first liquid level sensor 61 and the second liquid level sensor 62. In S24 the controller 130 executes an updating process.

Updating Process

Figure 9:
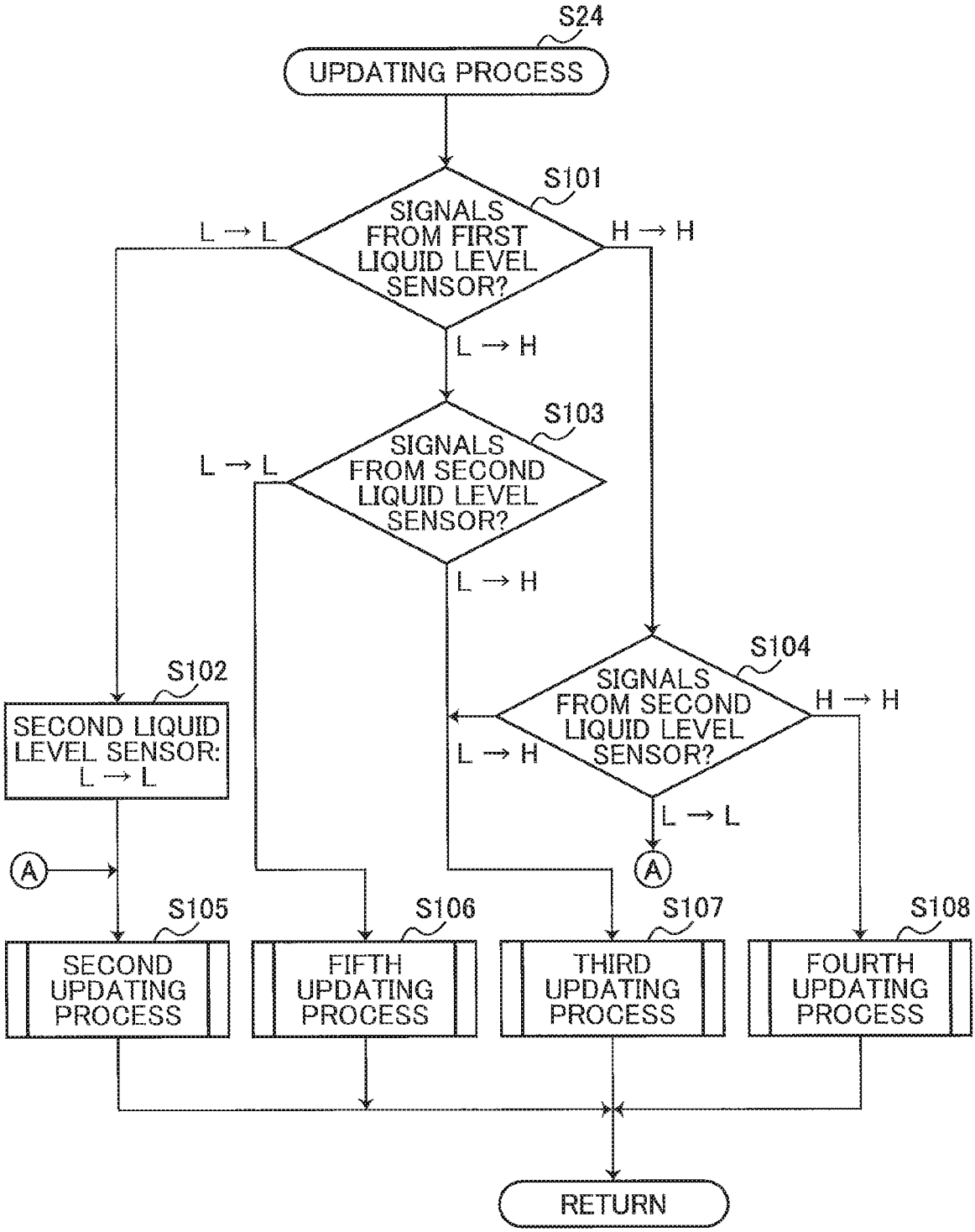
FIG. 9 is a flowchart illustrating steps in an updating process executed by the controller of the printer according to the first embodiment.

FIG. 9 illustrates steps in the updating process. In this process, the controller 130 sets the cartridge residual quantity and the tank residual quantity by executing one of second through fifth updating processes according to signals acquired from the first liquid level sensor 61 and the second liquid level sensor 62.

In S101 the controller 130 determines the liquid level signal acquired from the first liquid level sensor 61 in S21 and the liquid level signal acquired from the first liquid level sensor 61 in S23. Based on the determination results in S101, the controller 130 determines the liquid level signal acquired from the second liquid level sensor 62 in S21 and the liquid level signal acquired from the second liquid level sensor 62 in S23 (S102-S104).

If the controller 130 determines that the liquid level signals acquired from the first liquid level sensor 61 in S21 and S23 are both "L" (S101: L→L), and then in S102 confirms that the liquid level signals acquired from the second liquid level sensor 62 in S21 and S23 will both be "L" (S102: L→L). Subsequently, the controller 130 executes the second updating process of S105 described later. In this case, the liquid chamber 210 of the cartridge 200 and the liquid chamber 171 of the ink tank 160 both accommodate a sufficient quantity of ink before and after the print.

When the controller 130 determines that the liquid level signal acquired from the first liquid level sensor 61 in S21 is "L" and the liquid level signal acquired from the first liquid level sensor 61 in S23 is "H" (S101: L→H), the controller 130 advances to S103.

When the controller 130 determines that the liquid level signals acquired from the second liquid level sensor 62 in both S21 and S23 are both "L" (S103: L→L), the controller 130 executes the fifth updating process of S106 described later. In this case, the remaining ink accommodated in the liquid chamber 210 of the cartridge 200 has become low while printing was executed in S22.

If the controller 130 determines in S103 that the liquid level signal acquired from the second liquid level sensor 62 in S21 is "L" and the liquid level signal acquired from the second liquid level sensor 62 in S23 is "H" (S103: L→H), the controller 130 executes the third updating process of S107 described later. In this case, the liquid chamber 210 of the cartridge 200 ran out of ink while printing was executed in S22.

On the other hand, when the controller 130 determines in S101 that the liquid level signals acquired from the first liquid level sensor 61 in S21 and S23 are both "H" (S101: H→H), the controller 130 advances to S104.

When the controller 130 determines in S104 that the liquid level signal acquired from the second liquid level sensor 62 in S21 is "L" and the liquid level signal acquired from the second liquid level sensor 62 in S23 is "H" (S104: L→H), the controller 130 executes the third updating process of S107 described later. In this case, the liquid chamber 210 of the cartridge 200 ran out of ink while printing was executed in S22.

If the controller 130 determines in S104 that the liquid level signals acquired from the second liquid level sensor 62 in S21 and S23 are both "L" (S104: L→L), the controller 130 executes the second updating process of S105 described later. In this case, the residual quantity of ink in the liquid chamber 210 of the cartridge 200 was low before and after printing, but the liquid chamber 171 of the ink tank 160 stores a sufficient amount of ink.

When the controller 130 determines that the liquid level signals acquired from the second liquid level sensor 62 in S21 and S23 are both "H" (S104: H→H), the controller 130 executes the fourth updating process of S108 described later.

In S101-S104 when the pattern of liquid level signals acquired from the first liquid level sensor 61 and the second liquid level sensor 62 in S21 and liquid level signals acquired from the first liquid level sensor 61 and the second liquid level sensor 62 in S23 differs from the patterns described above, the controller 130 determines that at least one of the first liquid level sensor 61 and the second liquid level sensor 62 malfunctioned (S16). Also as in the process for determining the cartridge residual quantity (S16), the controller 130 issues a notification indicating that at least one sensor has malfunctioned.

After the controller 130 completes the updating process in S24, in S25 the controller 130 determines whether image data for other pages is stored in the RAM 57. If the controller 130 determines that there remains image data for another page in the RAM 57 (S25: YES), the controller 130 repeats the process beginning from S11. At this time, if the controller 130 determines that the value of the S_Empty flag in the EEPROM 56 is "OFF" (S11: OFF), the controller 130 repeats the process in S21-S24. If the controller 130 determines in S25 that image data for subsequent pages is not stored in the RAM 57 (S25: NO), the controller 130 ends the printing process.

Each time a print is executed in S22, the controller 130 sets the cartridge residual quantity and the tank residual quantity in the second through fifth updating processes within the updating process based on the quantity of ink used for printing. In the above description, the controller 130 sets the cartridge residual quantity and the tank residual quantity every time one page worth of data is printed. As an alternative, the controller 130 may set the cartridge residual quantity and the tank residual quantity each time one pass is printed. The controller 130 executes the second through fifth updating processes not only when printing, but also anytime that ink is ejected from the recording head 21 in order to perform maintenance or the like.

Second Updating Process

Figure 10B:
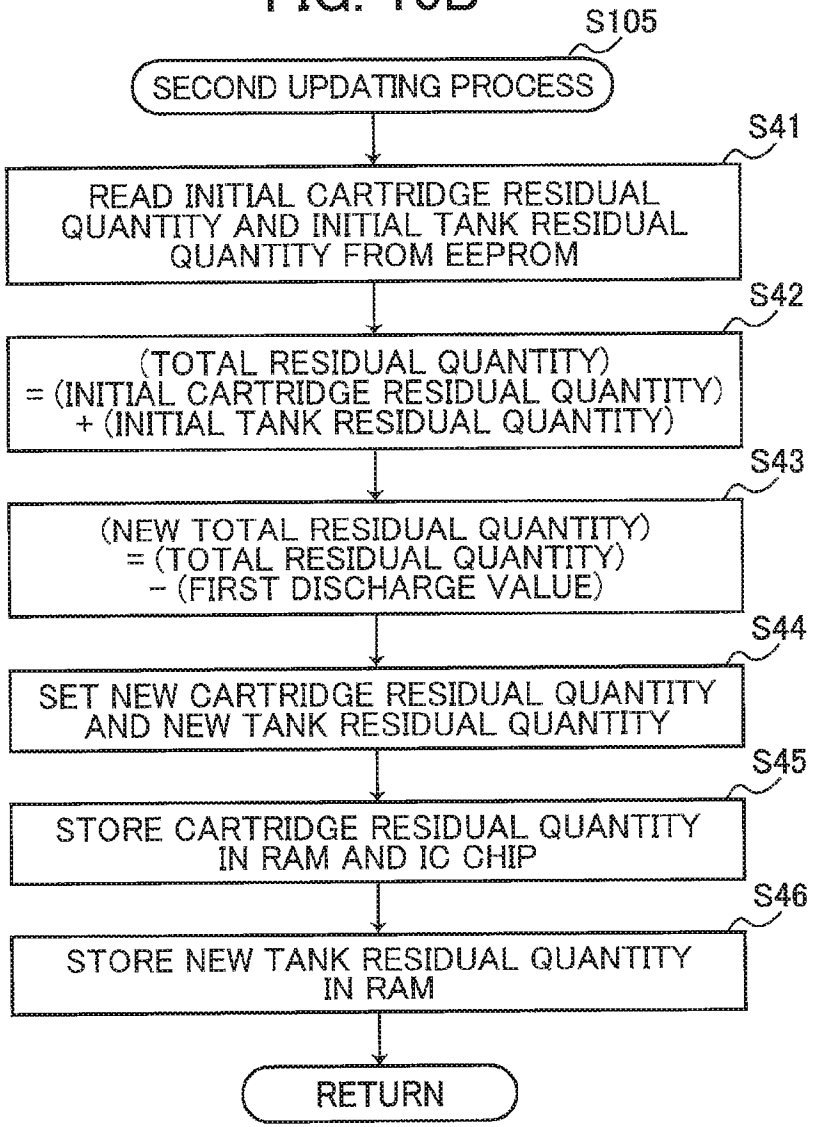
FIG. 10B is a flowchart illustrating steps in a second updating process executed by the controller of the printer.

The controller 130 executes the second updating process illustrated in FIG. 10B so as to set a new cartridge residual quantity and a new tank residual quantity based on a first discharge value specifying the quantity of ink discharged through the recording head 21 during printing and maintenance. The first discharge value is found by multiplying the quantity of one ink droplet ejected from the recording head 21 by the number of ink droplets ejected, for example. The first discharge value is an example of a count value. Each time the controller 130 gives a command to eject ink from the recording head 21, the controller 130 calculates the first discharge value based on this command. The controller 130 calculates a first discharge value that corresponds to the total quantity of ink ejected by the recording head 21 from the moment the cartridge 200 was mounted in the mounting case 150 to the present. Hence, the first discharge value is the cumulative quantity of ink ejected by the recording head 21 since the cartridge 200 was mounted. The first discharge value is stored in the EEPROM 56.

In S41 at the beginning of the second updating process, the controller 130 reads the initial cartridge residual quantity and the initial tank residual quantity from the EEPROM 56. In S42 the controller 130 calculates the total residual quantity by adding the initial cartridge residual quantity and the initial tank residual quantity read in S41. In S43 the controller 130 calculates a new total residual quantity by subtracting the first discharge value from the total residual quantity calculated in S42. The controller 130 store the calculated new total residual quantity in the EEPROM 56. In S44 the controller 130 sets a new cartridge residual quantity and a new tank residual quantity using the new total residual quantity calculated in S43 and the formulae or tables described earlier.

In S45 the controller 130 stores the new cartridge residual quantity set in S44 in the RAM 57, and updates the cartridge residual quantity stored in the memory on the IC chip 34 to the new cartridge residual quantity set in S44. In S46 the controller 130 also stores the new tank residual quantity set in S44 in the RAM 57. Subsequently, the controller 130 ends the second updating process.

Note that the method for setting the cartridge residual quantity and the tank residual quantity described above is merely an example and these quantities may be set according to another method.

Third Updating Process

Figure 10C:
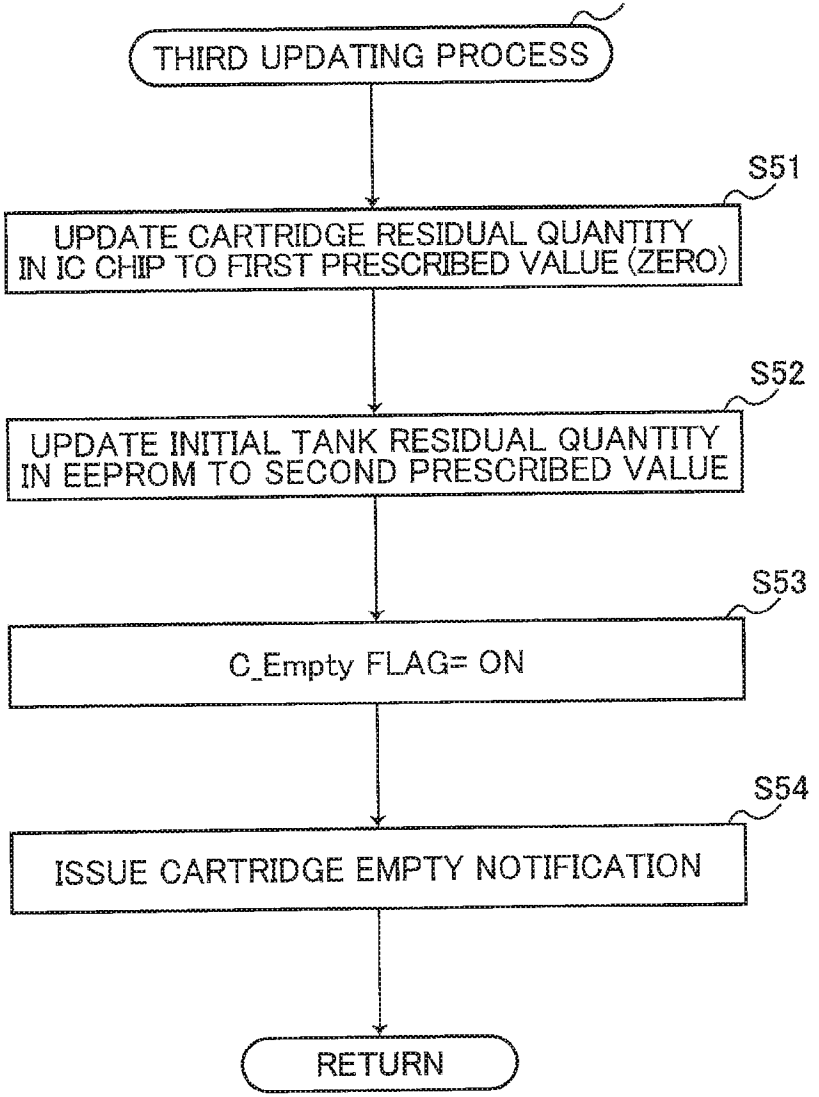
FIG. 10C is a flowchart illustrating steps in a third updating process executed by the controller of the printer.
Figure 10D:
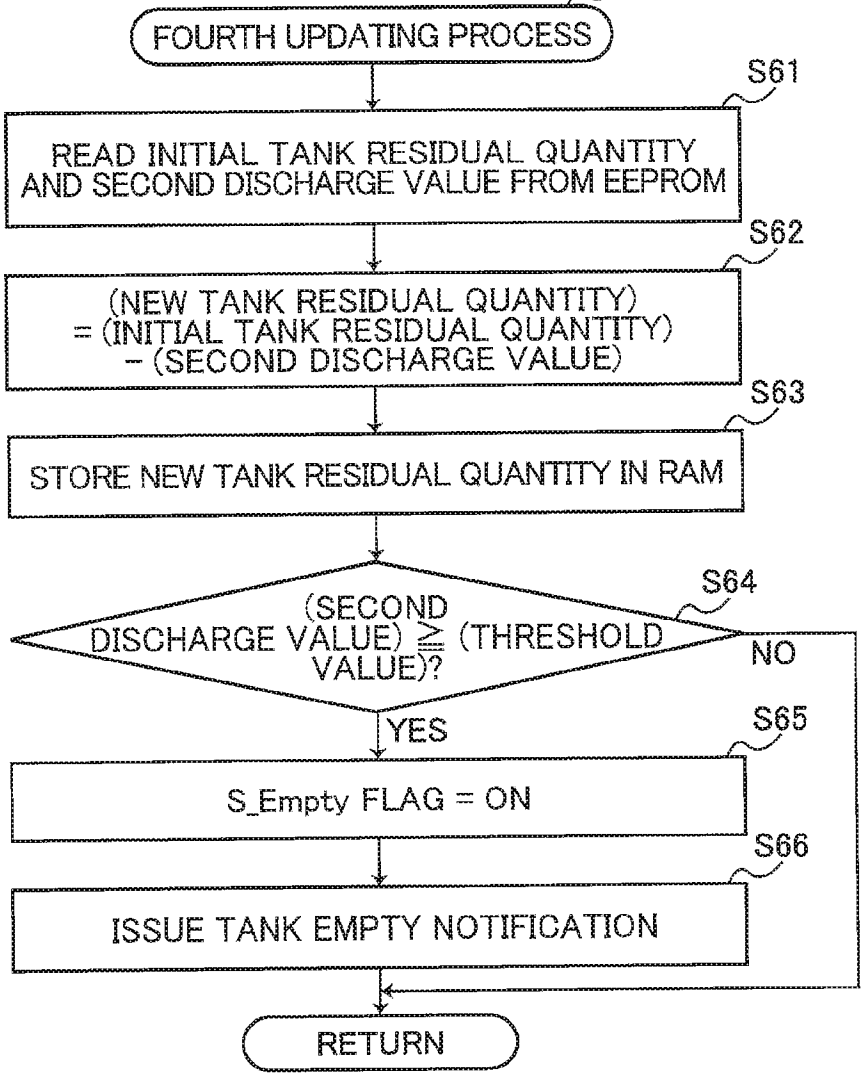
FIG. 10D is a flowchart illustrating steps in a fourth updating process executed by the controller of the printer.

The controller 130 executes the third updating process illustrated in FIG. 10C so as to update the initial cartridge residual quantity to a first prescribed value and so as to update the initial tank residual quantity to the second prescribed value. More specifically, the first discharge value indicating the quantity of ink discharged from the recording head 21 during printing and the like includes error. For example, even though the controller 130 commands the recording head 21 to eject ink in a specific quantity, the quantity of ink actually ejected from the recording head 21 may differ from the specific quantity directed by the controller 130. One factor of this difference may be the temperature when the ejection of ink is commanded, for example. That is, the viscosity of ink increases as temperature drops, and high-viscosity ink is more difficult to discharge through the nozzles 29. Further, when the controller 130 repeatedly issues the above command to the recording head 21, the difference between the quantity of ink actually discharged from the recording head 21 through these repetitions and the total amount of the specific quantity multiplied by the number of repetitions may increase. In other words, there is a possibility that the error between the quantity specified by the calculated first discharge value and the quantity actually discharged from the recording head 21 will accumulate each time a printing operation is performed.

Since the cartridge residual quantity is set according to this first discharge value, error is generated between the residual ink quantity specified by the cartridge residual quantity and the actual residual ink quantity in the liquid chamber 210. Further, since the tank residual quantity is set according to the first discharge value, error is also generated between the residual ink quantity specified by the tank residual quantity and the actual residual ink quantity in the liquid chamber 171. Consequently, the cartridge residual quantity and the tank residual quantity set every printing operation include accumulated error. The third updating process is performed to reset this accumulated error.

Specifically, in S51 of FIG. 10C, the controller 130 updates the cartridge residual quantity stored in the memory on the IC chip 34 to the first prescribed value, and stores the first prescribed value as the cartridge residual quantity in the RAM 57. The controller 130 also updates the initial cartridge residual quantity stored in the EEPROM 56 to the first prescribed value. The first prescribed value is a value specifying the quantity of ink stored in the liquid chamber 210 of the cartridge 200 when the ink level is at the second position P2. When the ink level is at the second position P2, ink stored in the liquid chamber 210 is not supplied to the liquid chamber 171, and thus it is estimated that no ink is stored in the liquid chamber 210. Accordingly, the first prescribed value is "0". In S52 the controller 130 updates the initial tank residual quantity in the EEPROM 56 to the second prescribed value. The controller 130 also updates the tank residual quantity in the RAM 57 to the second prescribed value. As described above, the second prescribed value indicates the quantity of ink stored in the liquid chamber 171 of the ink tank 160 when the level of ink is at the second position P2. The first prescribed value and the second prescribed value are stored in the ROM 37 in advance, for example.

The controller 130 also calculates the total residual quantity by adding the initial cartridge residual quantity (first prescribed value) updated in S51 to the initial tank residual quantity (second prescribed value) stored in S52. The controller 130 stores the calculated total residual quantity in the EEPROM 56.

In S53 the controller 130 stores the value "ON" in the C_Empty flag provided in the EEPROM 56. In S54 the controller 130 issues a cartridge empty notification as described in the process for determining the cartridge residual quantity (S16).

Fourth Updating Process

The controller 130 executes the fourth updating process illustrated in FIG. 10D so that the controller 130 calculates a tank residual quantity and determines whether printing is prohibited. In S61 at the beginning of the fourth updating process, the controller 130 reads the initial tank residual quantity, which was updated to the second prescribed value in S52, and the second discharge value from the EEPROM 56. In S62 the controller 130 subtracts the second discharge value from the initial tank residual quantity read in S61 to find a new tank residual quantity. As with the first discharge value, the second discharge value is obtained by multiplying the quantity of one ink droplet discharged from the recording head 21 by the number of times an ink droplet was discharged, for example. The second discharge value is an example of the count value. Each time the controller 130 issues a command to the recording head 21 to discharge ink, the controller 130 calculates the second discharge value based on the command. The controller 130 calculates the second discharge value to indicate the quantity of ink discharged by the recording head 21 from the time after the liquid level signal acquired from the second liquid level sensor 62 changed from "L" to "H" until the present time. Thus, the second discharge value is the cumulative quantity of ink discharged by the recording head 21 since the liquid level signal from the second liquid level sensor 62 changed from "L" to "H". This second discharge value is stored in the EEPROM 56.

In S63 the controller 130 stores the new tank residual quantity calculated in S63 in the RAM 57. Further, the controller 130 stores the new tank residual quantity as the total residual quantity in the EEPROM 56 because the cartridge 200 stores no ink at this time. In S64 the controller 130 determines whether the calculated second discharge value has reached a threshold value. The threshold value is stored in the ROM 37 or the EEPROM 56 in advance. When the controller 130 determines that the second discharge value has not yet reached the threshold value (S64: NO), the controller 130 ends the fourth updating process. However, if the controller 130 determines that the second discharge value has reached the threshold value (S64: YES), in S65 the controller 130 sets the S_Empty flag in the EEPROM 56 to the value "ON". In S66 the controller 130 issues a tank empty notification as described in the process for determining the tank residual quantity (S17-S19), and ends the fourth updating process. While not illustrated in the flowchart, if the controller 130 determines that the S_Empty flag is set to the value "ON", the controller 130 prevents the discharge of ink from the recording head 21 for purposes of printing or maintenance.

The threshold value is set such that the level of ink stored in the liquid chamber 171 of the ink tank 160 will be at a position slightly higher than the outlet 174 when the second discharge value reaches the threshold value. More specifically, error may occur between the design second position P2 for performing detections with the second liquid level sensor 62 and the second position P2 at which the second liquid level sensor 62 actually performs detections. Thus, the threshold value is set such that the level of ink accommodated in the liquid chamber 171 of the ink tank 160 will not overlap the outlet 174 when the second discharge value reaches the threshold value, even if the error reaches the maximum possible value anticipated during design. By preventing ink from being discharged from the recording head 21, the controller 130 restricts air from being introduced into the recording head 21. Note that in addition to considerations for the error described above, the threshold value may be set such that the level of ink stored in the liquid chamber 171 of the ink tank 160 does not overlap the outlet 174 when the second discharge value reaches the threshold value, even if the printer 10 is resting on a sloped surface that slopes at a prescribed angle of inclination. In addition, the second discharge value may also include error, as with the first discharge value. Thus, the threshold value may be set such that the level of ink stored in the liquid chamber 171 of the ink tank 160 does not overlap the outlet 174 when the second discharge value reaches the threshold value, even if the second discharge value contains the maximum error.

Fifth Updating Process

Figure 11:
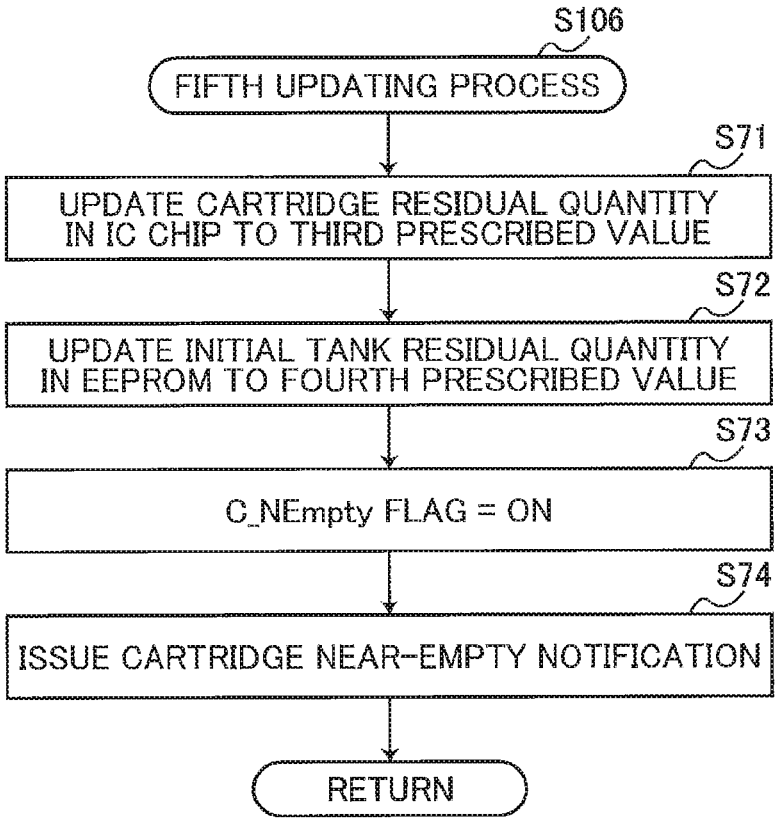
FIG. 11 is a flowchart illustrating steps in a fifth updating process executed by the controller of the printer according to the first embodiment.

In the fifth updating process shown in FIG. 11, the controller 130 updates the initial cartridge residual quantity to the third prescribed value, and updates the initial tank residual quantity to the fourth prescribed value.

The third prescribed value denotes the quantity of ink accommodated in the liquid chamber 210 of the cartridge 200 when the level of ink is at the first position P1. The third prescribed value is pre-stored in the ROM 37, for example.

The fourth prescribed value denotes the quantity of ink accommodated in the liquid chamber 171 of the ink tank 160 when the level of ink is at the first position P1. The fourth prescribed value is pre-stored in the ROM 37 for example.

In S71 of the fifth updating process, the controller 130 updates the cartridge residual quantity stored in the memory of the IC chip 34 to the third prescribed value, and stores the third prescribed value in the RAM 57 as the cartridge residual quantity. The controller 130 also updates the initial cartridge residual quantity stored in the EEPROM 56 to the third prescribed value.

In S72 the controller 130 updates the initial tank residual quantity in the EEPROM 56 to the fourth prescribed value. The controller 130 also stores the fourth prescribed value in the RAM 57 as the tank residual quantity.

The controller 130 calculates the total residual quantity by adding the initial cartridge residual quantity (the third prescribed value) updated in S71 to the updated initial tank residual quantity (the fourth prescribed value). The controller 130 stores the calculated total residual quantity in the EEPROM 56.

In S73 the controller 130 stores the value "ON" in the C_NEmpty flag provided in the EEPROM 56. In S74 the controller 130 issues a cartridge near-empty notification as described in the process for determining the cartridge residual quantity (S16), and subsequently ends the fifth updating process.

Contact Information Transmission Process

Figure 12:
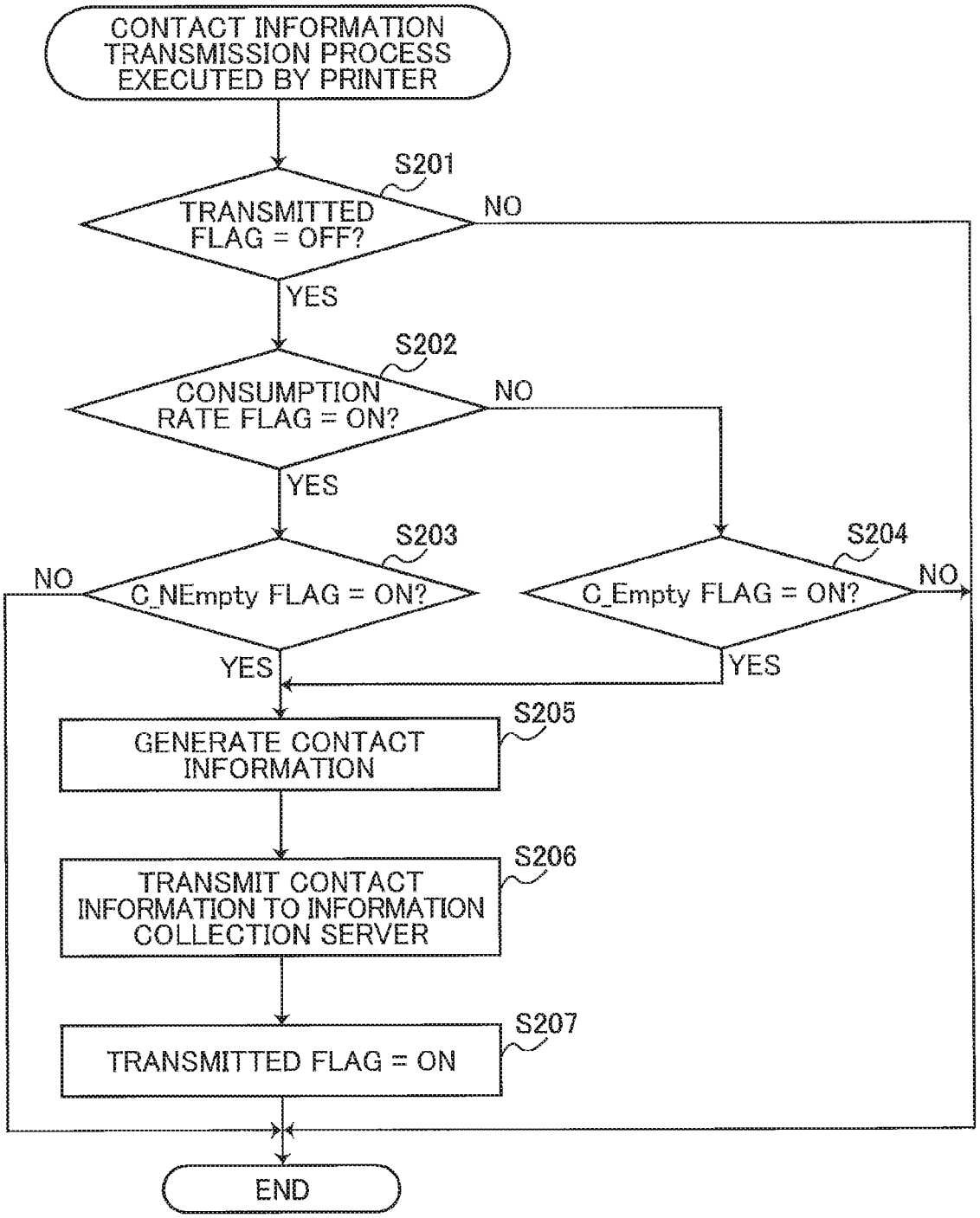
FIG. 12 is a flowchart illustrating steps in a contact information transmission process executed by the controller of the printer.

The controller 130 of the printer 10 periodically executes a contact information transmission process shown in FIG. 12. Specifically, the controller 130 executes the contact information transmission process when the date and time information outputted by the clock 30 reaches a prescribed fixed time stored in the ROM 37 or the EEPROM 56. The prescribed fixed time is the time at each interval of 5 minutes, 10 minutes, or 1 hour, for example. The controller 130 executes the contact information transmission process at each prescribed fixed time. Note that the controller 130 may instead execute the contact information transmission process at prescribed time intervals. For example, the controller 130 executes the contact information transmission process when elapsed time tracked by the clock 30 reaches a prescribed duration (5 minutes, 10 minutes, or 1 hour, for example).

In the contact information transmission process, the printer 10 transmits contact information to the information collection server 40. The contact information is used by the information collection server 40 to determine whether to transmit order information to the shipping server 50 for ordering cartridges 200. This contact information transmission process will be described next with reference to FIG. 12.

In S201 of FIG. 12, the controller 130 determines whether the value of the transmitted flag provided in the EEPROM 56 is "OFF". If the transmitted flag in the EEPROM 56 is set to "ON" rather than "OFF" (S201: NO), the controller 130 ends the contact information transmission process. However, if the controller 130 determines that the transmitted flag is set to "OFF" (S201: YES), in S202 the controller 130 references the EEPROM 56 to determine whether first information or second information is stored in the EEPROM 56.

The first information indicates that ink in the liquid chamber 210 and the liquid chamber 171 is consumed at a high rate of speed, while the second information indicates that the rate of ink consumption in the liquid chamber 210 and the liquid chamber 171 is slower than that indicated by the first information. The controller 130 selectively stores the first information and the second information in the EEPROM 56. Here, a consumption rate flag described later is provided in the EEPROM 56. The controller 130 treats a value of "ON" in the consumption rate flag to indicate that first information is stored in the EEPROM 56, and treats a value of "OFF" to indicate that second information is stored in the EEPROM 56. Hence, in S202 the controller 130 determines whether the consumption rate flag in the EEPROM 56 is set to "ON".

Note that the content of the first information and the second information is not limited to an "ON" or "OFF" value stored in the consumption rate flag, but may be any arbitrary condition for distinguishing consumption rates.

In the embodiment, the controller 130 stores "OFF" as the initial value of the consumption rate flag. As will be described later in greater detail, the controller 130 calculates the consumption rate (consumption speed) for ink stored in the liquid chamber 210 and the liquid chamber 171. Based on this calculation, the controller 130 stores the value "ON" in the consumption rate flag when the calculated consumption rate is higher than the prescribed rate pre-stored in the EEPROM 56, and stores the value "OFF" in the consumption rate flag when the calculated consumption rate is lower than the prescribed rate. In the embodiment, the controller 130 also stores the value "ON" in the consumption rate flag when the calculated consumption rate is equal to the prescribed rate, but the controller 130 may be configured to store an "OFF" value in this case instead.

The consumption rate is calculated as follows.

When a cartridge 200 is mounted (S12, FIG. 7), the controller 130 stores the total residual quantity at this time (the initial total residual quantity) in the EEPROM 56. The initial total residual quantity is the sum of the cartridge residual quantity stored in the storage 36 in S36 (FIG. 10A) of the first updating process (S15), and the tank residual quantity stored in the storage 36 in S37 (FIG. 10A) of the first updating process (S15). Each time the cartridge residual quantity and the tank residual quantity are updated, the controller 130 calculates the total residual quantity at this time and stores this quantity in the EEPROM 56. The initial total residual quantity and the updated total residual quantity are thus stored in the EEPROM 56.

The controller 130 uses the clock 30 to count time that has elapsed since the mounted date and time stored in the EEPROM 56 in S38 (FIG. 10A) of the first updating process. When the elapsed time tracked by the clock 30 reaches a prescribed time pre-stored in the EEPROM 56, the controller 130 reads the total residual quantity at this time (the updated total residual quantity) and the total residual quantity when the cartridge 200 was mounted (the initial total residual quantity) from the EEPROM 56. Next, the controller 130 calculates the ink consumption rate by dividing the difference between these two total residual quantities by the elapsed time to the present time from the time when the updated total residual amount is acquired from the mounted date and time. The controller 130 compares the calculated ink consumption rate with the prescribed rate prestored in the EEPROM 56. That is, the prescribed rate is a threshold value by which the controller 130 determines whether the rate of ink consumption in the liquid chamber 210 and the liquid chamber 171 is high. If the calculated ink consumption rate is greater than or equal to the prescribed rate, the controller 130 sets "ON" for the consumption rate flag. If the calculated ink consumption rate is smaller than the prescribed rate, the controller 130 sets "OFF" for the consumption rate flag. The prescribed time may be the time at each interval of 1 minute, 10 minutes, 1 hour, 10 hours, 1 day, 1 week, or 1 month, for example.

In the embodiment, the controller 130 stores the value "ON" or "OFF" in the consumption rate flag based on the calculated ink consumption rate, but the method of setting the consumption rate flag is not limited to this method. For example, the controller 130 may store the value "ON" or "OFF" in the consumption rate flag based on the number of printed pages for prescribed intervals (monthly, for example) determined when the user of the printer 10 enters an agreement with the manufacturer of the printer 10. For example, the controller 130 may store the value "ON" in the consumption rate flag when the number of printed pages in the prescribed period exceeds a prescribed number (5,000 pages, for example) and may store the value "OFF" in the consumption rate flag when the number of printed pages in the prescribed period is less than or equal to the prescribed number.

If the value "ON" is stored in the consumption rate flag (S202: YES), in S203 the controller 130 determines whether the value of the C_NEmpty flag is "ON". Thus, the controller 130 determines whether the amount of ink remaining in the liquid chamber 210 of the cartridge 200 is low. If the controller 130 determines that the C_NEmpty flag is set to "ON" (S203: YES), in S205 the controller 130 generates contact information. Specifically, the controller 130 reads type information for the cartridge 200 from the memory of the IC chip 34 provided on the cartridge 200 and also reads device information for the printer 10 from the EEPROM 56. The controller 130 generates contact information that includes the read type information and device information. Note that the controller 130 may have stored the type information read from the memory of the IC chip 34 on the cartridge 200 in the EEPROM 56, and may read the type information from the EEPROM 56 and include this type information in the contact information at this time.

The type information includes information indicating whether the cartridge 200 is a small-capacity cartridge or a large-capacity cartridge, and information indicating the color of ink accommodated therein. The device information for the printer 10 includes identification information for the printer 10, such as the MAC address or serial number of the printer 10. The identification information for the printer 10 is stored in the EEPROM 56.

After generating the contact information in S205, in S206 the controller 130 transmits this contact information to the information collection server 40 via the communication interface 31. In S207 the controller 130 stores the value "ON" in the transmitted flag provided in the EEPROM 56, and subsequently ends the contact information transmission process. The information collection server 40 subsequently receives the contact information transmitted from the printer 10.

On the other hand, if the controller 130 determines in S203 that the C_NEmpty flag is set to "OFF" (S203: NO), the controller 130 ends the contact information transmission process without creating contact information (S205), transmitting the contact information (S206), or storing the value "ON" in the transmitted flag (S207).

If the value "ON" is not stored in the consumption rate flag (S202: NO), in S204 the controller 130 determines whether the C_Empty flag is set to "ON". In other words, the controller 130 determines whether no ink is accommodated in the liquid chamber 210 of the cartridge 200. If the controller 130 determines that the value of the C_Empty flag is "ON" (S204: YES), the controller 130 creates the contact information (S205), transmits the contact information (S206), stores the value "ON" in the transmitted flag (S207), and ends the contact information transmission process. However, if the controller 130 determines that the value of the C_Empty flag is "OFF" (S204: NO), the controller 130 ends the contact information transmission process without executing the process in S205-S207.

Order Information Transmission Process

Figure 13B:
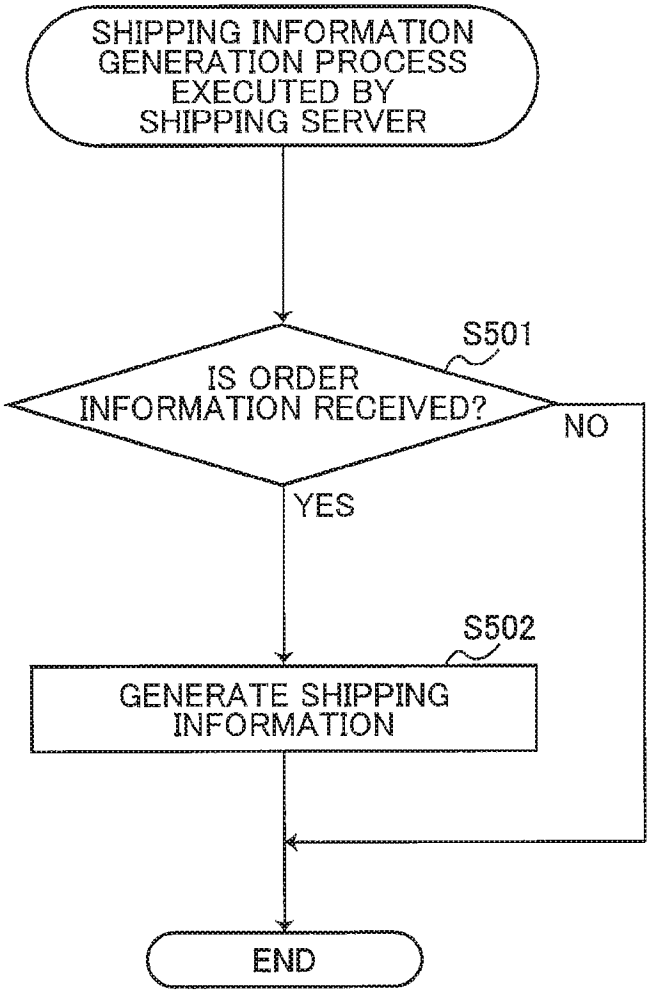
FIG. 13B is a flowchart illustrating steps in a shipping information generation process executed by a controller of a shipping server.
Figure 13A:
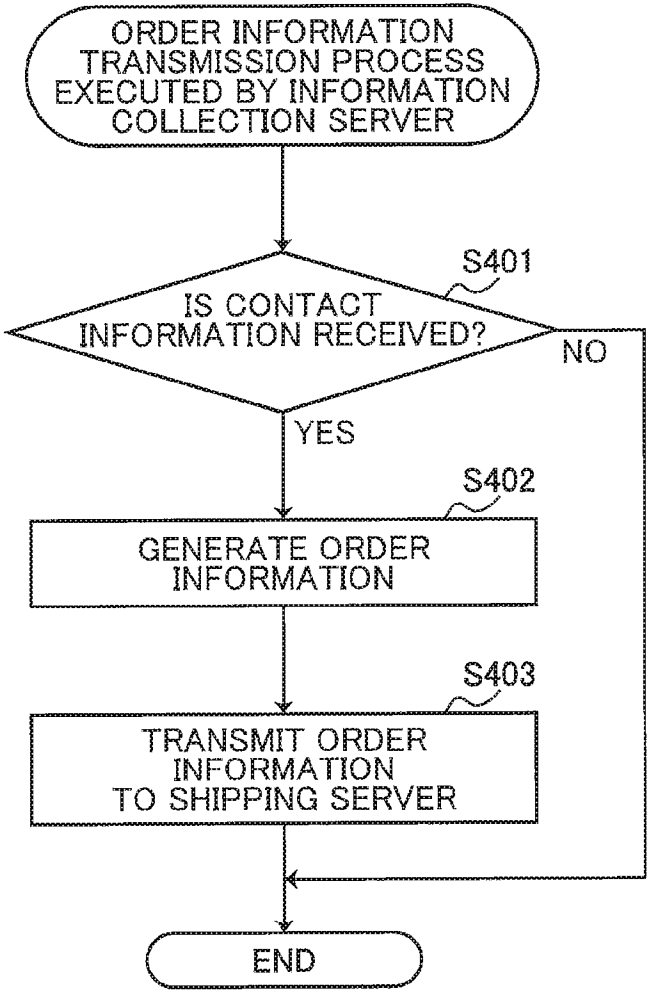
FIG. 13A is a flowchart illustrating steps in an order information transmission process executed by a controller of the information collection server.

When the information collection server 40 receives contact information from the printer 10, the controller 45 of the information collection server 40 executes an order information transmission process. This process will be described next with reference to FIG. 13A. The controller 45 of the information collection server 40 periodically executes the order information transmission process shown in FIG. 13A. Specifically, the controller 45 executes this process when the date and time information outputted by the clock 48 reaches a prescribed fixed time stored in the storage 42. The prescribed fixed time is the time at each interval of 5 minutes, 10 minutes, or 1 hour, for example. The controller 45 executes the order information transmission process at each prescribed fixed time. Note that the controller 45 may execute the order information transmission process at prescribed time intervals. For example, when a length of time tracked by the clock 48 reaches a prescribed length of time (5 minutes, 10 minutes, or 1 hour, for example), the controller 45 executes the order information transmission process. Note that the controller 45 may execute the order information transmission process in a time slot that includes the time at which the printer 10 transmits the contact information.

In S401 at the beginning of the order information transmission process, the controller 45 determines whether contact information was received via the communication interface 43. If contact information was not received (S401: NO), the controller 45 ends the order information transmission process. However, when the controller 45 determines that contact information was received via the communication interface 43 (S401: YES), in S402 the controller 45 generates order information.

The order information includes the type information for the cartridge 200 included in the contact information; user information including the name and address for the destination of the cartridge 200; and the like. The order information is for ordering a new cartridge 200 of a type identified by the type information. The controller 45 references the storage 42 using the identification information included in the contact information for the printer 10, and reads the user information that is associated with this identification information. The controller 45 includes this user information in the order information.

After generating the order information in S402, in S403 the controller 45 stores the order information in the storage 42 and transmits the order information to the shipping server 50 via the communication interface 44. The shipping server 50 subsequently receives the order information transmitted from the information collection server 40 via the communication interface 53.

Shipping Information Generation Process

When the shipping server 50 receives order information from the information collection server 40, the controller 55 of the shipping server 50 executes a shipping information generation process. This process will be described next with reference to FIG. 13B. The controller 55 of the shipping server 50 periodically executes the shipping information generation process. Note that the controller 55 may execute the process in a time slot that includes the timing at which the information collection server 40 transmits contact information. In S501 at the beginning of the shipping information generation process, the controller 55 of the shipping server 50 determines whether order information was received via the communication interface 53. If the controller 55 determines that order information was not received (S501: NO), the controller 55 ends the shipping information generation process. However, when the controller 55 determines that order information was received (S501: YES), in S502 the controller 55 generates shipping information, and subsequently ends the shipping information generation process.

The shipping information indicates that the cartridge 200 identified by the type information included in the order information is to be shipped to the name and address specified in the user information included in the order information. The shipping information generated by the shipping server 50 is used in operations for shipping cartridges 200.

Effects of the First Embodiment

According to the first embodiment, the printer 10 can detect the level of ink in the liquid chamber 210 of the cartridge 200 with high accuracy using the first liquid level sensor 61.

According to the first embodiment, the level of ink in the liquid chamber 210 of the cartridge 200 need not be detected with the second liquid level sensor 62. Accordingly, the mounted position of the second liquid level sensor 62 need not be aligned with the mounted height of the cartridge 200, allowing the second liquid level sensor 62 to be positioned near the bottom of the liquid chamber 171 in the ink tank 160. With this arrangement, the printer 10 can quickly detect when ink has been supplied from the cartridge 200 to the ink tank 160.

According to the first embodiment, the second liquid level sensor 62 is used to detect the level of ink in the liquid chamber 171 of the ink tank 160. Accordingly, the printer 10 can detect the level of ink in the liquid chamber 171 of the ink tank 160 with better accuracy than when using a software count.

According to the first embodiment, the first liquid level sensor 61 can be used to detect with high accuracy when the liquid chamber 210 can no longer provide ink to the liquid chamber 171.

According to the first embodiment, the printer 10 can use the first liquid level sensor 61 to detect when the quantity of ink remaining in the liquid chamber 210 that can be supplied to the liquid chamber 171 is low, and can use the second liquid level sensor 62 to detect when the liquid chamber 210 has run out of ink that can be supplied to the liquid chamber 171.

According to the first embodiment, cartridges 200 can be ordered earlier when the rate of ink consumption in the printer 10 is high.

According to the first embodiment, the rate of ink consumption in the printer 10 can be derived from the actual state of ink consumption.

According to the first embodiment, by executing steps S13 and S14 the printer 10 can cancel a suspension on driving of the recording head 21 at an early stage if the newly mounted cartridge 200 stores a fixed quantity of ink.

According to the first embodiment, the printer 10 can learn the state of ink movement between the liquid chamber 210 and the liquid chamber 171 based on detection results received from the first liquid level sensor 61 when the cartridge 200 is mounted.

Second Embodiment

In the first embodiment, the first position P1 is located above the ink supply opening 234, and the second position P2 is arranged at the same height in the up-down directions 7 as the axial center of the needle 181 and the center of the ink supply opening 234. However, the first position P1 and the second position P2 are not limited to the positions in the first embodiment. The first position P1 and the second position P2 may be set to the positions in the example described below.

Figure 14:
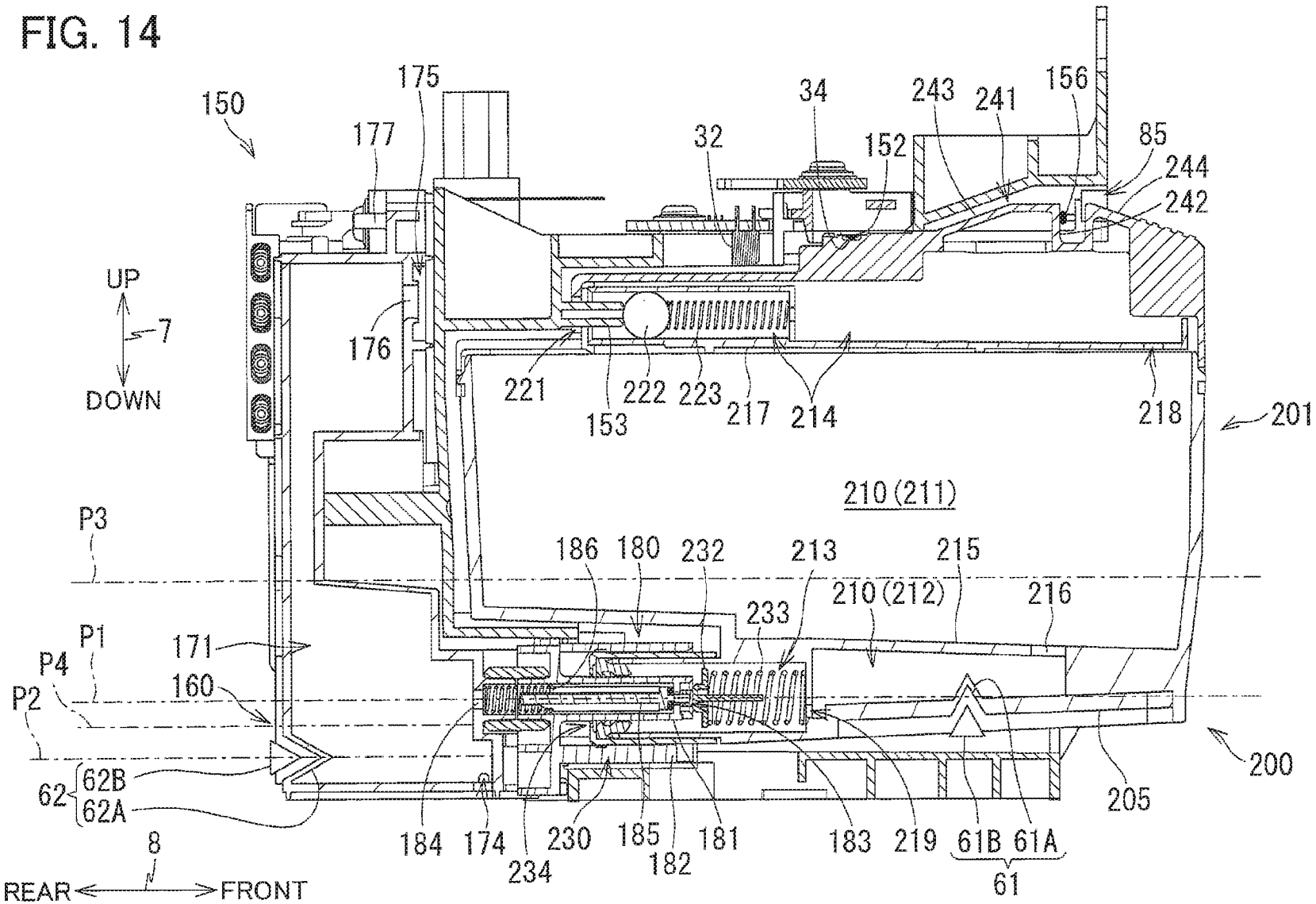
FIG. 14 is a vertical cross-sectional view of a mounting case in which a cartridge is mounted in a printer according to a second embodiment.

In the second embodiment, the first position P1 is arranged at the same height as the axial center of the needle 181, the center of the ink supply opening 234, and a center of the through-hole 184, as illustrated in FIG. 14. The second position P2 is located below the first position P1 and above the outlet 174. In the second embodiment, the second position P2 is slightly higher than the outlet 174.

The first liquid level sensor 61 and the second liquid level sensor 62 have the same structure as in the first embodiment, differing from the first embodiment only in their positions. The prism 61A of the first liquid level sensor 61 is provided in the bottom wall 205 of the cartridge 200. The light-emitting element 61B and the light-receiving element of the first liquid level sensor 61 are arranged in confrontation with the prism 61A from below. The second liquid level sensor 62 is aligned with the second position P2 at a lower position than the position of the second liquid level sensor 62 of the first embodiment.

When the liquid level signal acquired from the first liquid level sensor 61 is "L" in the second embodiment, the controller 130 determines that the liquid chamber 210 accommodates ink and records the value "OFF" in the C_Empty flag. However, if the liquid level signal acquired from the first liquid level sensor 61 is "H", the controller 130 determines that the liquid chamber 210 does not store ink, records the value "ON" in the C_Empty flag, and issues a cartridge empty notification.

Further, if the liquid level signal acquired from the second liquid level sensor 62 is "L" in the second embodiment, the controller 130 determines that the liquid chamber 171 stores a sufficient quantity of ink, records the value "OFF" in the S_Empty flag, and permits ejection of ink from the recording head 21. However, if the liquid level signal acquired from the second liquid level sensor 62 is "H", the controller 130 determines that the quantity of ink stored in the liquid chamber 171 is low, records the value "ON" in the S_Empty flag, and prohibits the ejection of ink from the recording head 21. Thus, the controller 130 in the second embodiment prohibits or halts driving of the recording head 21 when the quantity of liquid in the liquid chamber 171 is no greater than a prescribed quantity (a quantity corresponding to the volume of the liquid chamber 171 for the region below the second position P2).

Figure 15:
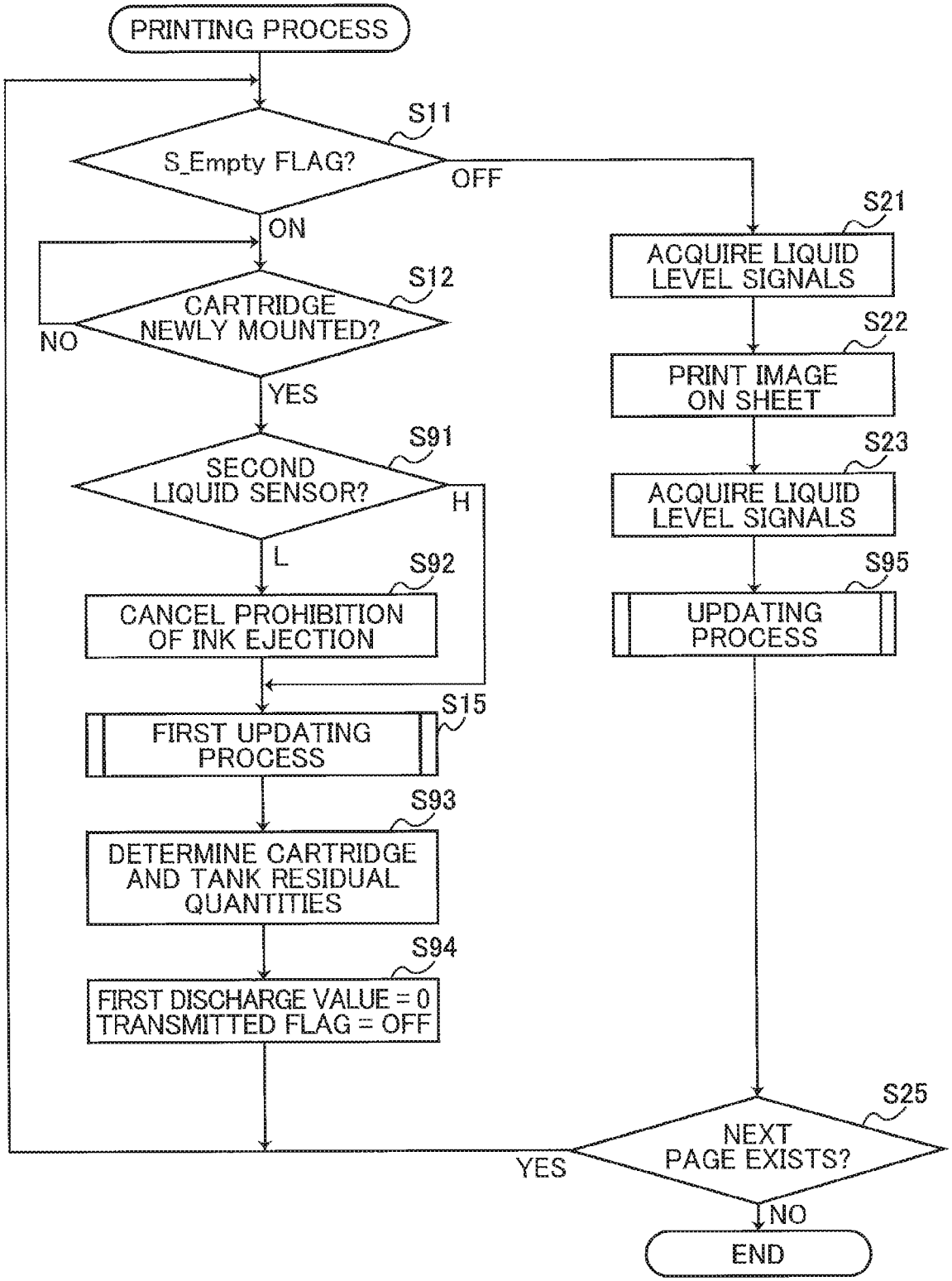
FIG. 15 is a flowchart illustrating steps in a printing process executed by a controller of the printer according to the second embodiment.
Figure 17:
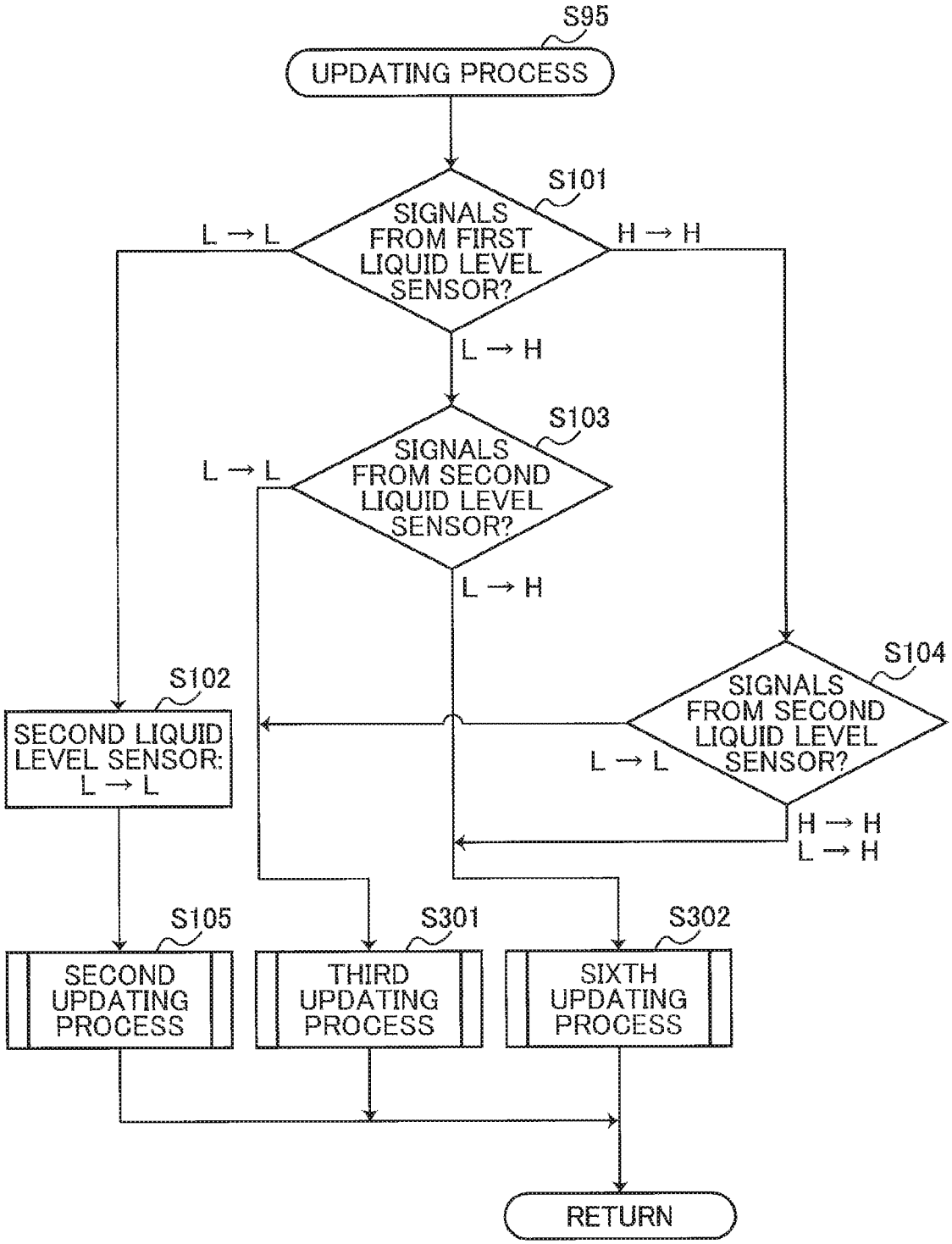
FIG. 17 is a flowchart illustrating steps in an updating process executed by the controller of the printer according to the second embodiment.

In the second embodiment, the controller 130 of the printer 10 executes the printing process shown in FIG. 15 in place of the printing process of FIG. 7 according to the first embodiment, and executes the updating process shown in FIG. 17 in place of the updating process of the first embodiment shown in FIG. 9. All processes other than those described below are identical to the processes described in the first embodiment. In the processes shown in FIGS. 15 and 17, steps identical to those in the first embodiment are designated with the same step numbers to avoid duplicating description.

In the printing process shown in FIG. 15, the controller 130 executes steps S11, S12, S15, S21-S23, and S25 as in the first embodiment. However, in the second embodiment the controller 130 executes steps S91, S92, S93, S94, and S95 in place of steps S13, S14, S16-S19, S20, and S24 according to the first embodiment. Below, the processes performed in steps S91-S95 will be described.

After determining that a cartridge 200 was mounted in S12 of FIG. 15 (S12: YES), the controller 130 determines whether to cancel the prohibition of ink ejection from the recording head 21. This will be described below in greater detail. When a cartridge 200 is mounted (S12: YES) while ink ejection from the recording head 21 is prohibited (while the S_Empty flag is set to the value "ON"; S11: ON), in S91 the controller 130 references the liquid level signal acquired from the second liquid level sensor 62. If the liquid level signal is "L" (S91: L), the controller 130 determines that the liquid chamber 171 stores a sufficient quantity of ink for the level of ink to reach a height at or above the second position P2. In this case, in S92 the controller 130 cancels the prohibition of ink ejection from the recording head 21, i.e., permits ink ejection from the recording head 21 by setting the S_Empty flag to "OFF". However, if the liquid level signal is "H" (S91: H), the controller 130 continues to prohibit ink ejection from the recording head 21. In this case, the prohibition of ink ejection from the recording head 21 can only be cancelled on the condition that the value of the S_Empty flag is subsequently set to "OFF" (S93) owing to ink being supplied from a cartridge 200 to the ink tank 160, for example.

After determining whether to cancel the prohibition on ink ejection from the recording head 21, the controller 130 executes the first updating process in S15. After completing the first updating process of S15, in S93 the controller 130 executes a process to determine the cartridge and tank residual quantities. In the process for determining the cartridge and tank residual quantities, the controller 130 determines the residual quantity of ink stored in the liquid chamber 210 and the residual quantity of ink stored in the liquid chamber 171, and stores the value "ON" or "OFF" in each of the C_Empty flag and S_Empty flag based on the determination results.

In the process for determining the cartridge and tank residual quantities, the controller 130 determines results and stores the values "ON" or "OFF" in the C_Empty flag and S_Empty flag according to the table in FIG. 16. That is, the controller 130 references liquid level signals acquired from the first liquid level sensor 61 and the second liquid level sensor 62 during the prescribed period for mounting the cartridge 200, determines mounting results for the cartridge 200 based on the referenced liquid level signals, and stores "ON" or "OFF" in the C_Empty flag and the S_Empty flag according to these results.

Results of mounting the cartridge 200 will be described next in greater detail with reference to FIG. 16. The controller 130 determines that a normal cartridge 200 with a large residual quantity of ink (a new cartridge 200, for example) was mounted in the following two cases: when the liquid level signal acquired from the first liquid level sensor 61 is kept to "L" and the liquid level signal acquired from the second liquid level sensor 62 is kept to "L" during the prescribed period for mounting the cartridge 200; and when the liquid level signal acquired from the first liquid level sensor 61 is kept to "L" and the liquid level signal acquired from the second liquid level sensor 62 changed from "H" to "L" during the prescribed period for mounting the cartridge 200.

The controller 130 determines that an empty cartridge 200 storing no ink has been mounted in the following three cases: when the liquid level signal acquired from the first liquid level sensor 61 is kept to "H" and the liquid level signal acquired from the second liquid level sensor 62 is kept to "L" during the prescribed period for mounting the cartridge 200; when the liquid level signal acquired from the first liquid level sensor 61 is kept to "H" and the liquid level signal acquired from the second liquid level sensor 62 is kept to "H" during the prescribed period for mounting the cartridge 200; and when the liquid level signal acquired from the first liquid level sensor 61 is kept to "H" and the liquid level signal acquired from the second liquid level sensor 62 changed from "H" to "L" during the prescribed period for mounting the cartridge 200.

The controller 130 determines that a cartridge 200 having a low residual quantity of ink was mounted and that the liquid chamber 210 ran out of ink by supplying ink to the liquid chamber 171 in the following three cases: when the liquid level signal acquired from the first liquid level sensor 61 changed from "L" to "H" and the liquid level signal acquired from the second liquid level sensor 62 is kept to "L" during the prescribed period for mounting the cartridge 200; when the liquid level signal acquired from the first liquid level sensor 61 changed from "L" to "H" and the liquid level signal acquired from the second liquid level sensor 62 is kept to "H" during the prescribed period for mounting the cartridge 200; and when the liquid level signal acquired from the first liquid level sensor 61 changed from "L" to "H" and the liquid level signal acquired from the second liquid level sensor 62 changed from "H" to "L" during the prescribed period for mounting the cartridge 200.

The controller 130 determines that ink flowed upstream from the liquid chamber 171 to the liquid chamber 210 when the cartridge 200 was mounted when the liquid level signal acquired from the first liquid level sensor 61 changed from "H" to "L" and the liquid level signal acquired from the second liquid level sensor 62 is kept to "L" during the prescribed period for mounting the cartridge 200.

As described above, the controller 130 stores the value "ON" or "OFF" in each of the C_Empty flag and the S_Empty flag based on signals acquired from the first liquid level sensor 61 and the second liquid level sensor 62 (signals following a change; see FIG. 16). The controller 130 issues a cartridge empty notification when the value "ON" is stored in the C_Empty flag. When the value "ON" is stored in the S_Empty flag, the controller 130 issues a tank empty notification and prohibits ink ejection from the recording head 21. When the value "OFF" is stored in the S_Empty flag, the controller 130 cancels the prohibition on ink ejection from the recording head 21.

If the liquid level signals acquired from the first liquid level sensor 61 and the second liquid level sensor 62 during the prescribed period for mounting the cartridge 200 are any other pattern than the patterns described above, the controller 130 determines that at least one of the first liquid level sensor 61 and the second liquid level sensor 62 has malfunctioned, as in the first embodiment, and issues a notification to this effect (indicating that at least one sensor has malfunctioned). Further, when the controller 130 determines that ink has flowed upstream from the liquid chamber 171 to the liquid chamber 210 in the process for determining the cartridge and tank residual quantities, the controller 130 issues a notification to this effect.

After completing the process for determining the cartridge and tank residual quantities in S93, in S94 the controller 130 stores the value "0" in the EEPROM 56 as the first ejection value, and stores the value "OFF" in a transmitted flag provided in the EEPROM 56.

After completing the print in S22, in S23 the controller 130 acquires liquid level signals from the first liquid level sensor 61 and the second liquid level sensor 62. Subsequently in S95 the controller 130 executes an updating process.

FIG. 17 illustrates steps in the updating process. In this process, the controller 130 sets the cartridge residual quantity and the tank residual quantity by executing one of the second updating process, a third updating process, and a sixth updating process based on the signals acquired from the first liquid level sensor 61 and the second liquid level sensor 62.

The series of steps in which the controller 130 executes the second updating process of S105 after determinations in S101 and S102 is identical to that described in the first embodiment.

When the controller 130 determines in S101 that the liquid level signal acquired from the first liquid level sensor 61 in S21 is "L" and the liquid level signal acquired from the first liquid level sensor 61 in S23 is "H" (S101: L→H) and determines in S103 that the liquid level signals acquired from the second liquid level sensor 62 in S21 and S23 are both "L" (S103: L→L), in S301 the controller 130 executes the third updating process shown in FIG. 10C. In this case, all remaining ink in the liquid chamber 210 of the cartridge 200 was used while executing the print in S22.

Note that the first prescribed value and the second prescribed value are used in the third updating process (S51 and S52). Here, the first prescribed value and the second prescribed value in the second embodiment are defined differently from those in the first embodiment. Specifically, in the first embodiment, the first prescribed value and the second prescribed value are defined according to quantities of ink whose level are at the second position P2. However, in the second embodiment, the first prescribed value and the second prescribed value are defined according to quantities of ink whose level is at the first position P1. More specifically, in the second embodiment, the first prescribed value is defined as a value specifying the quantity of ink stored in the liquid chamber 210 of the cartridge 200 when the ink level is at the first position P1. Because the first position P1 according to the second embodiment is the same as the second position P2 according to the first embodiment, the first prescribed value is "0" in the second embodiment, similarly to the first embodiment. In the second embodiment, the second prescribed value is defined as a value specifying the quantity of ink stored in the liquid chamber 171 of the ink tank 160 when the ink level is at the first position P1. The value itself of the second prescribed value in the second embodiment is also the same as the first embodiment because the first position P1 according to the second embodiment is the same as the second position P2 according to the first embodiment.

The controller 130 also executes the third updating process of S301 shown in FIG. 10C when determining in S101 that the liquid level signals acquired from the first liquid level sensor 61 in S21 and S23 are both "H" (S101: H→H) and that the liquid level signals acquired from the second liquid level sensor 62 in S21 and S23 are both "L" (S104: LL). In this case, the liquid chamber 210 of the cartridge 200 stores no ink when starting S22.

When the controller 130 determines in S101 that the liquid level signal acquired from the first liquid level sensor 61 in S21 is "L" and the liquid level signal acquired from the first liquid level sensor 61 in S23 is "H" (S101: L→H) and determines in S103 that the liquid level signal acquired from the second liquid level sensor 62 in S21 is "L" and the liquid level signal acquired from the second liquid level sensor 62 in S23 is "H" (S103: L→H), in S302 the controller 130 executes the sixth updating process shown in FIG. 18. In this case, ink stored in the liquid chamber 171 of the ink tank 160 became low while executing the print in S22, and there is a chance that the level of ink could drop to the top of the outlet 174.

Figure 18:
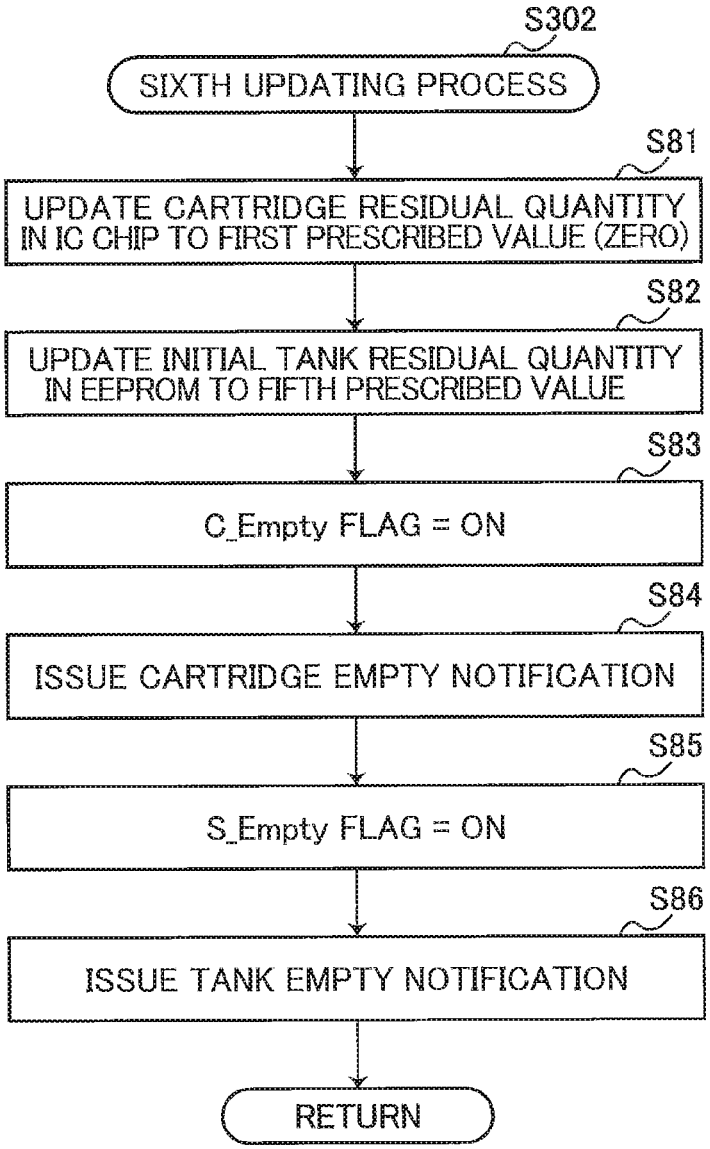
FIG. 18 is a flowchart illustrating steps in a sixth updating process executed by the controller of the printer according to the second embodiment.

The controller 130 also executes the sixth updating process of S302 shown in FIG. 18 when determining in S101 that the liquid level signals acquired from the first liquid level sensor 61 in S21 and S23 are both "H" (S101: H→H) and that the liquid level signal acquired from the second liquid level sensor 62 in S23 is "H" irrespective of the liquid level signal acquired from the second liquid level sensor 62 in S21 (S104: L→H).

In the sixth updating process of FIG. 18, the controller 130 updates the initial cartridge residual quantity to the first prescribed value and updates the initial tank residual quantity to the second prescribed value.

In S81 at the beginning of the sixth updating process, the controller 130 updates the cartridge residual quantity stored in the memory of the IC chip 34 to the first prescribed value, and stores the first prescribed value as the cartridge residual quantity in the RAM 57, as described in S51 of the third updating process. Further, the controller 130 updates the initial cartridge residual quantity in the EEPROM 56 to the first prescribed value. As in the third updating process, the first prescribed value in the sixth updating process is "0". In S82 the controller 130 stores the tank residual quantity in the RAM 57 as a fifth prescribed value. Further, the controller 130 updates the initial tank residual quantity in the EEPROM 56 to the fifth prescribed value. The fifth prescribed value is defined as a value specifying the quantity of ink stored in the liquid chamber 171 of the ink tank 160 when the ink level is at the first position P2. Since the second position P2 in the second embodiment is lower than the second position P2 in the first embodiment, the fifth prescribed value is smaller than the second prescribed value in the second embodiment.

In S83 the controller 130 stores the value "ON" in the C_Empty flag provided in the EEPROM 56. In S84 the controller 130 issues a cartridge empty notification, as described in the process for determining the cartridge and tank residual quantities (S93). In S85 the controller 130 stores the value "OFF" in the S_Empty flag provided in the EEPROM 56. In S86 the controller 130 issues a tank empty notification, as described in the process for determining the cartridge and tank residual quantities (S93). When the controller 130 determines that the value "ON" is stored in the S_Empty flag provided in the EEPROM 56, the controller 130 prohibits the ejection of ink from the recording head 21 whether for printing or maintenance.

The contact information transmission process shown in FIG. 12 and the order information transmission process shown in FIG. 13 of the first embodiment described above are also executed in the second embodiment.

Here, the controller 130 may determine whether the level of ink has dropped to a third position P3 (see FIG. 14) that is higher than the first position P1 based on a value obtained by counting the quantity of ink droplets ejected from the recording head 21, and may issue a cartridge near-empty notification when the level of ink reaches the third position P3.

Effects of the Second Embodiment

According to the second embodiment, the second liquid level sensor 62 can detect accurately that the liquid chamber 210 cannot supply ink into the liquid chamber 171.

According to the second embodiment, the first liquid level sensor 61 can detect that the liquid chamber 210 no longer stores ink that can be supplied to the liquid chamber 171. By using the second liquid level sensor 62 to detect whether ink was supplied from the liquid chamber 210 to the liquid chamber 171, the printer 10 can detect the level of ink in the liquid chamber 171 more accurately than when using a software count. This can reduce the potential for air flowing through the outlet 174 due to the level of ink in the liquid chamber 171 dropping below the top of the outlet 174.

Further, since the printer 10 cancels the suspension on driving of the recording head 21 based on detections by the second liquid level sensor 62, which is positioned below the ink supply opening 234 and above the outlet 174, the printer 10 can quickly cancel this suspension.

Variation

In the embodiments described above, ink flows from the cartridge 200 to the ink tank 160 owing to a hydraulic head differential. However, the ink may be configured to flow from the cartridge 200 to the ink tank 160 by gravity or through use of a pump or the like. Hence, the present invention can be applied to a printer that uses gravity to supply ink from the cartridge to the ink tank.

Next, an example of a printer that uses gravity to supply ink from the cartridge to the ink tank will be described with reference to FIG. 19. In this example, ink is supplied from a cartridge 300 into an ink tank 350 utilizing what is referred to as a chicken feed system.

Figure 19:
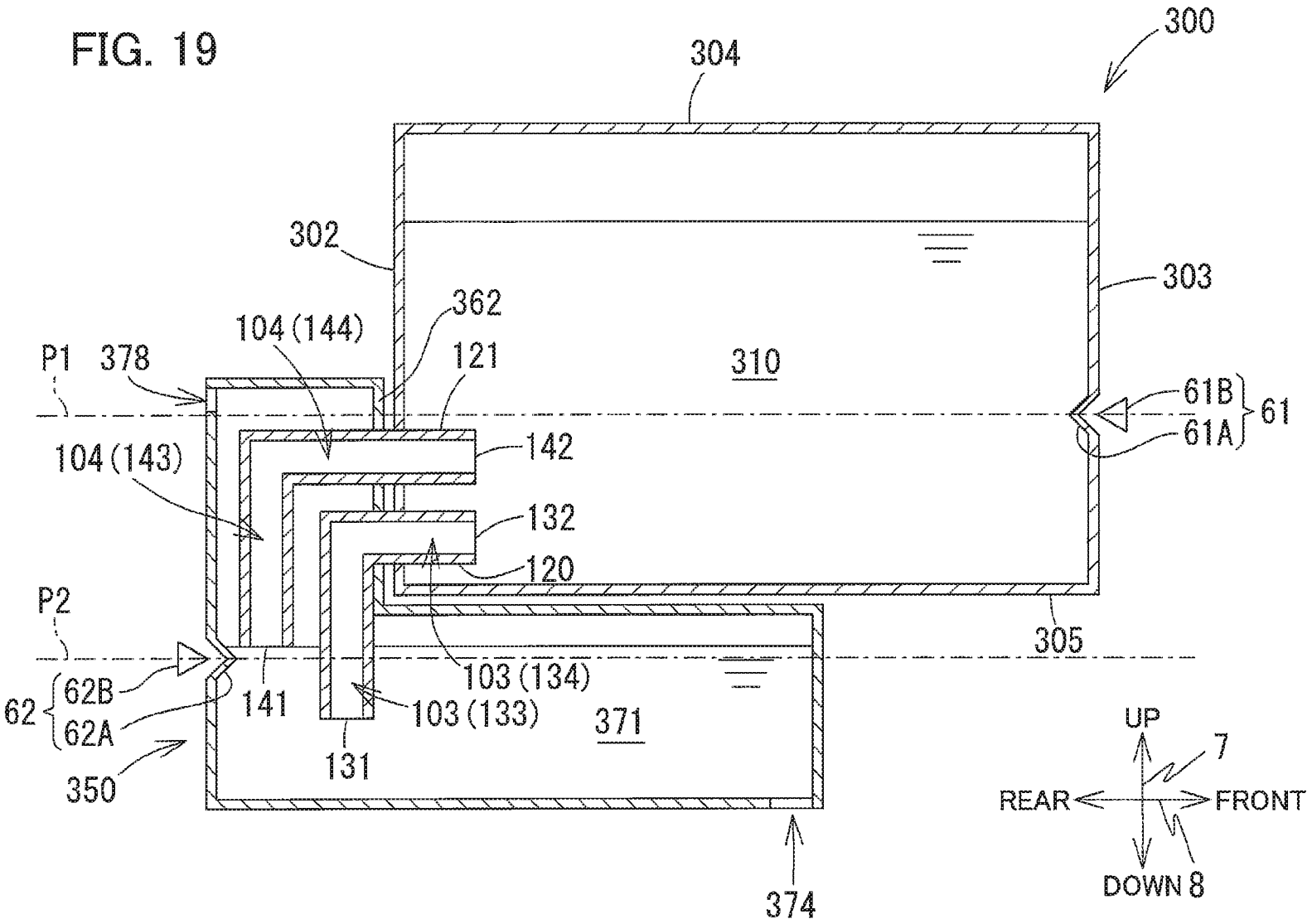
FIG. 19 is a vertical cross-sectional view of a mounting case in which a cartridge is mounted in a printer according to a variation.

As shown in FIG. 19, the printer 10 in this example is provided with ink tanks 350, and cartridges 300 that can be respectively mounted on the ink tanks 350. A mounting case (not shown in FIG. 19) of the printer 10 is shaped to conform to the cartridges 300 and the ink tanks 350. Contacts 152, mounting sensors 32, and the like provided in the mounting case. IC chips 34, light-blocking ribs 245, and the like provided on the cartridges 300 have identical configurations to those described in the first embodiment. Therefore, these components have been omitted from FIG. 19, and a description of these components will not be repeated herein.

The cartridge 300 is a receptacle having a liquid chamber 310 (an example of the first liquid chamber) for storing a liquid, such as ink. The cartridge 300 is configured of a rear wall 302, a front wall 303, a top wall 304, a bottom wall 305, and a pair of side walls (not shown).

A liquid chamber 371 is formed inside the ink tank 350. The ink tank 350 is in communication with the recording head 21 via an outlet 374 (an example of the second outlet) and a tube.

The ink tank 350 is also provided with joints 120 and 121. The joints 120 and 121 are tube-like members extending forward from a front wall 362 of the ink tank 350. The interior spaces of the joints 120 and 121 are in communication with the liquid chamber 371 via through-holes penetrating the front wall 362. The joints 120 and 121 are juxtaposed vertically with the joint 120 beneath the joint 121.

The ink tank 350 is also provided with a liquid channel 103 (an example of the second channel) and an air channel 104 (an example of the first channel) that communicate with the liquid chamber 371. The liquid channel 103 is formed inside the liquid chamber 371 and the joint 120. The air channel 104 is formed inside the liquid chamber 371 and the joint 121. The ink tank 350 is also provided with an air communication port 378 that communicates with the atmosphere outside the liquid chamber 371. The air channel 104 is configured so that air can pass therethrough but ink cannot pass therethrough. For example, the inner diameter of the air channel 104 is so small that only air can pass therethrough but ink cannot pass therethrough. On the other hand, the liquid channel 103 is configured so that ink can pass therethrough.

The liquid channel 103 has a first opening 131 (an example of the inlet), a second opening 132, a vertical section 133, and an extended section 134. The first opening 131 is formed in one end of the liquid channel 103 and is in communication with the liquid chamber 371. The first opening 131 forms an opening that opens downward in the end of the liquid channel 103. The second opening 132 is formed in the opposite end of the liquid channel 103 from the first opening 131 and communicates with the exterior of the ink tank 350. The second opening 132 forms an opening that opens forward in the end of the liquid channel 103. The second opening 132 is positioned inside the liquid chamber 310 of the cartridge 300 when the cartridge 300 is connected to the ink tank 350. At this time, the second opening 132 functions as the first outlet. The vertical section 133 is the section of the liquid channel 103 that extends upward from the first opening 131. The extended section 134 is the section of the liquid channel 103 that extends rearward from the second opening 132. The top end of the vertical section 133 is connected to the rear end of the extended section 134. As shown in FIG. 19, the outlet 374 is positioned entirely beneath the first opening 131, but the outlet 374 may be configured so that only a portion of the outlet 374 is positioned beneath the first opening 131. The second opening 132 is disposed periphery of the bottom wall 305. In this example, the second opening 132 is slightly above the bottom wall 305.

The air channel 104 has a third opening 141, a fourth opening 142, a vertical section 143, and an extended section 144. The third opening 141 is formed in one end of the air channel 104 and communicates with the liquid chamber 371. The third opening 141 forms an opening that opens downward in the end of the air channel 104. The fourth opening 142 is formed in the opposite end of the air channel 104 from the third opening 141 and communicates with the exterior of the ink tank 350. The fourth opening 142 forms an opening that opens forward in the end of the air channel 104. The fourth opening 142 communicates with the liquid chamber 310 of the cartridge 300 when the cartridge 300 is connected to the ink tank 350. The vertical section 143 is the section of the air channel 104 that extends upward from the third opening 141. The extended section 144 is the section of the air channel 104 that extends rearward from the fourth opening 142. The top end of the vertical section 143 is connected to the rear end of the extended section 144.

The third opening 141 is positioned lower than the air communication port 378. The first opening 131 is positioned lower than the third opening 141.

In the configuration shown in FIG. 19, the first position P1 and the second position P2 are set at positions corresponding to the configuration in FIG. 6. The second position P2 is slightly lower than the bottom end of the third opening 141. The second liquid level sensor 62 is disposed in a position corresponding to the second position P2. The first position P1 is positioned higher than the second opening 132. The first liquid level sensor 61 is disposed in a position corresponding to the first position P1.

Note that the first position P1, the second position P2, the position of the first liquid level sensor 61, and the position of the second liquid level sensor 62 are not limited to the positions described above. For example, the first position P1 and the second position P2 in the configuration shown in FIG. 19 may be set to positions corresponding to the configuration shown in FIG. 14.

Next, the process by which ink in the cartridge 300 is supplied into the ink tank 350 with the arrangement shown in FIG. 19 (when the cartridge 300 is mounted in the mounting case and connected to the ink tank 350) will be described. In this variation, ink is supplied from the cartridge 300 to the ink tank 350 according to the chicken feed system. This system will be described next in greater detail.

When the cartridge 300 is connected to the ink tank 350 so that the second opening 132 and the fourth opening 142 are positioned inside the liquid chamber 310 of the cartridge 300, the liquid chamber 310 is in communication with the liquid chamber 371 via each of the liquid channel 103 and the air channel 104. At this time, ink stored in the liquid chamber 310 flows into the liquid channel 103 through the second opening 132 and out through the first opening 131 into the liquid chamber 371. As ink flows in this way, air enters the liquid chamber 371 through the air communication port 378 and flows into the liquid chamber 310 via the air channel 104. Here, the volume of ink flowing from the liquid chamber 310 into the liquid chamber 371 is approximately equivalent to the volume of air flowing from the liquid chamber 371 into the liquid chamber 310, allowing for gas-liquid replacement to occur.

As ink flows into the liquid chamber 371, the level of the ink rises in the liquid chamber 371. When the surface of the ink reaches the third opening 141, air is prevented from circulating between the liquid chamber 371 and the liquid chamber 310 through the air channel 104. Consequently, ink flow from the liquid chamber 310 to the liquid chamber 371 is halted.

Other Variations

In the above descriptions, examples of the first position P1 and the second position P2 are described for positions shown in FIGS. 6, 14, and 19. However, the first position P1 and the second position P2 are not limited to the positions in FIGS. 6, 14, and 19. The first position P1 may be set to any position between the top and bottom of the liquid chamber 210 (or 310), and the second position P2 may be set to any position between the top and bottom of the liquid chamber 171 (or 371). For example, the second position P2 may be set to a position above the first position P1. The second position P2 is preferably higher than the outlet 174 (374).

The first position P1 and the second position P2 may also be set to the same height. In this case, if the cartridge 200 and the ink tank 160 are arranged horizontally to each other, the timing at which the signal acquired from the first liquid level sensor 61 changes from "L" to "H" (hereinafter called the first timing) will coincide with the timing at which the signal acquired from the second liquid level sensor 62 changes from "L" to "H" (hereinafter called the second timing). However, if the printer 10 (the cartridge 200 and the ink tank 160) is disposed on an inclined plane, the first timing does not coincide with the second timing. Hence, the controller 130 can estimate an inclination between the cartridge 200 and the ink tank 160 relative to the horizontal direction based on the time differential between the first timing and the second timing. The controller 130 can then correct the first ejection value and the second ejection value based on the inferred inclination.

In the first embodiment described above, the controller 130 stores the value "ON" in the S_Empty flag when a value counted based on the quantity of ink droplets ejected from the recording head 21 (the second ejection value in the first embodiment) reaches a threshold value. In other words, the controller 130 determines the residual quantity of ink in the liquid chamber 171 based on a value counted according to the quantity of ink droplets ejected from the recording head 21 in addition to signals acquired from the first liquid level sensor 61 and second liquid level sensor 62. This determination can be performed for other steps or processes, such as setting the C_Empty flag or C_Nempty flag, in addition to storing the value "ON" in the S_Empty flag in the first embodiment described above.

Also in the second embodiment, the controller 130 may determine whether the level of ink has dropped to a fourth position P4 (see FIG. 14) that is lower than the first position P1 and higher than the second position P2 based on a value obtained by counting the quantity of ink droplets ejected from the recording head 21, and may prohibit the ejection of ink from the recording head 21 when the level of ink has reached the fourth position P4. Thus, the controller 130 may prohibit the ejection of ink from the recording head 21 before the signal acquired from the second liquid level sensor 62 changes from "L" to "H" (S103: L→H in FIG. 17).

In the embodiments, the first liquid level sensor 61 and the second liquid level sensor 62 optically detect the level of ink in the liquid chamber 210 (or 310) and the liquid chamber 171 (or 371) using prisms whose reflectance changes depending on whether ink is in contact therewith. However, the first liquid level sensor 61 and the second liquid level sensor 62 are not limited to sensors that use prisms, but may be any type of sensor that can detect the level of ink in the liquid chamber 210 (310) and the liquid chamber 171 (371). For example, actuators may be disposed in the liquid chamber 171 (371, 210, or 310). The actuators rotate depending on the level of ink in the liquid chamber 171 (371, 210, or 310). The first liquid level sensor 61 and the second liquid level sensor 62 detect the position of each actuator. Alternatively, the first liquid level sensor 61 and the second liquid level sensor 62 may be rod electrodes inserted into the liquid chamber 171 (371, 210, or 310), for example.

In the embodiments, the printer 10 transmits the contact information to the information collection server 40 and, upon receiving the contact information, the information collection server 40 transmits the order information to the shipping server 50 via the communication interface 44. However, these processes executed by the controller 45 of the information collection server 40 may instead be executed by the controller 130 of the printer 10. In other words, rather than transmitting contact information, the printer 10 may transmit order information to the shipping server 50 via the communication interface 31.

In the embodiment, ink is used as an example of the liquid, but the cartridge may store a pretreatment liquid that is ejected onto the paper or the like prior to the ink during a printing operation, or water for cleaning the recording head 21.

The air valve chamber 214 of the cartridge 200 is in communication with the atmosphere via the communication port 221 in the embodiments. However, the air valve chamber 214 may be in connection with the air communication chamber 175 of the mounting case 150 via the communication port 221, and be in communication with the atmosphere through the air communication chamber 175, the air communication chamber 175, and the air communication port 177.

What is claimed is:

1. An image-recording device comprising:

a cartridge having a first chamber configured to accommodate liquid, a first outlet, and a first sensor; and a mount body to which the cartridge is detachably mounted, the mount body including a tank which is configured to be in connection with the cartridge when the cartridge is mounted to the mount body, and a second sensor, the tank having an inlet, and a second chamber configured to accommodate liquid, the liquid in the first chamber being capable of flowing into the second chamber via the first outlet of the cartridge and the inlet of the tank, wherein the first sensor of the cartridge is configured to output a first signal when a level of the liquid accommodated in the second chamber is higher than a first position, whereas the first sensor is configured to output a second signal when the level of the liquid accommodated in the second chamber is lower than the first position, and wherein the second sensor of the tank is configured to output a third signal when a level of the liquid accommodated in the second chamber is higher than a second position which is lower than the first position, whereas the second sensor is configured to output a fourth signal when the level of the liquid accommodated in the second chamber is lower than the second position which is lower than the first position.

2. The image-recording device according to claim 1, wherein one of the first position and the second position is equal to a position of the first outlet of the cartridge in a vertical direction.

3. The image-recording device according to claim 2, wherein the first position is higher than the position of the first outlet of the cartridge, and wherein the second position is equal to the position of the first outlet of the cartridge in the vertical direction.

4. The image-recording device according to claim 3, wherein the mount body further includes a head in liquid communication with the second chamber, a communication interface, a memory, and a controller configured to receive signals from the first sensor and the second sensor, and wherein the controller is configured to perform:

selectively storing first information and second information in the memory, the first information indicating that a consumption speed of the liquid in the first chamber and the second chamber is faster than a prescribed speed, the second information indicating that the consumption speed is slower than the prescribed speed;

transmitting order information via the communication interface when the first information is stored in the memory and the controller receives the second signal from the first sensor; and transmitting the order information via the communication interface when the second information is stored in the memory and the controller receives the fourth signal from the second sensor.

5. The image-recording device according to claim 4, wherein the mount body further includes a third sensor, wherein the third sensor is configured to output a fifth signal when the cartridge is in connection with the tank whereas the third sensor is configured to output a sixth signal when the cartridge is separated from the tank, wherein the memory stores in advance the prescribed speed, wherein the memory stores a total liquid quantity which indicates a sum of a first quantity of liquid accommodated in the first chamber and a second quantity of liquid accommodated in the second chamber, and wherein the controller is further configured to perform:

updating a count value in accordance with ejection of liquid from the head; and updating the total liquid quantity based on the count value;

calculating the consumption speed based on a first total liquid quantity and a second total liquid quantity, the first total liquid quantity being a total liquid quantity calculated at a calculation time when signals from the third sensor changes from the sixth signal to the fifth signal, the second total liquid quantity being a total liquid quantity calculated after a prescribed period elapses from the calculation time;

storing the first information in the memory when the calculated consumption speed is faster than the prescribed speed stored in the memory; and storing the second information in the memory when the calculated consumption speed is slower than the prescribed speed stored in the memory.

6. The image-recording device according to claim 2, wherein the tank further includes a second outlet through which liquid in the second chamber is capable of flowing out, at least part of the second outlet of the tank being lower than the inlet of the tank, wherein the first position is equal to the position of the first outlet of the cartridge in the vertical direction, and wherein the second position is lower than the first outlet of the cartridge and higher than the second outlet of the tank.

7. The image-recording device according to claim 6, wherein the mount body further includes a controller and a head in liquid communication with the second chamber, and wherein the controller is configured to perform:

prohibiting the head from driving when an amount of liquid in the second chamber is lower than a prescribed amount; and in a case where a new cartridge is mounted on the mount body and the controller subsequently receives the third signal from the second sensor after prohibiting the head from driving, cancelling the prohibiting.

8. The image-recording device according to claim 1, wherein the first position is higher than the first outlet of the cartridge, wherein the mount body further includes a controller and a head in liquid communication with the second chamber, and wherein the controller is configured to perform:

prohibiting the head from driving when an amount of liquid in the second chamber is lower than a prescribed amount; and in a case where a new cartridge is mounted on the mount body and the controller subsequently receives the first signal from the first sensor after prohibiting the head from driving, cancelling the prohibiting.

9. The image-recording device according to claim 1, wherein the first position is higher than the second position.

10. The image-recording device according to claim 1, wherein the cartridge further has a first air communication portion used for air-communication between the first chamber and atmosphere, and wherein the tank further has a second air communication portion used for air-communication between the second chamber and atmosphere.

11. The image-recording device according to claim 1, wherein the tank further has a first channel, a second channel, and an air communication portion used for air-communication between the second chamber and atmosphere, wherein the first chamber is capable of communicating with the second chamber via each of the first channel and the second channel, wherein the first channel has one end positioned in the second chamber and another end positioned in the first chamber when the cartridge is mounted on the mount body, the one end of the first channel being lower than the air communication portion, and wherein the second channel has one end positioned in the second chamber and another end positioned in the first chamber when the cartridge is mounted on the mount body, the one end of the second channel being lower than the one end of the first channel, the one end of the second channel constituting the inlet of the tank and the another end of the second channel constituting the first outlet of the cartridge.

12. The image-recording device according to claim 1, wherein the tank further has an air channel, a liquid channel, and an air communication portion used for air-communication between the second chamber and atmosphere, wherein the air channel allows air communication between the first chamber and the second chamber, and wherein the liquid channel allows liquid communication between the first chamber and the second chamber.

* * * * *